US005262834A

United States Patent [19]

Kusaka et al.

[11] Patent Number: 5,262,834

[45] Date of Patent: Nov. 16, 1993

[54] IMAGE FIXING APPARATUS

[75] Inventors: Kensaku Kusaka, Kawasaki; Shigeo Kimura, Yokohama; Atsushi Hosoi, Kawasaki; Hiroyuki Adachi, Tokyo; Hidekazu Maruta, Hachiohji; Akira Yamamoto, Tokyo, all of Japan

[73] Assignee: Canon Kabushiki Kaisha, Tokyo, Japan

[21] Appl. No.: 444,802

[22] Filed: Dec. 1, 1989

[30] Foreign Application Priority Data

| | | | |
|---|---|---|---|
| Dec. 6, 1988 | [JP] | Japan | 63-308662 |
| Dec. 12, 1988 | [JP] | Japan | 63-313272 |
| Dec. 12, 1988 | [JP] | Japan | 63-313273 |
| Dec. 12, 1988 | [JP] | Japan | 63-313276 |
| Dec. 12, 1988 | [JP] | Japan | 63-313277 |
| Dec. 13, 1988 | [JP] | Japan | 63-315333 |
| Jun. 22, 1989 | [JP] | Japan | 1-160271 |

[51] Int. Cl.[5] ..... G03G 15/20

[52] U.S. Cl. ..... 355/285; 219/216; 355/290

[58] Field of Search ..... 355/285, 290, 289, 282, 355/295, 203, 206; 219/216; 430/60

[56] References Cited

U.S. PATENT DOCUMENTS

| | | | |
|---|---|---|---|
| 3,811,828 | 5/1974 | Ohta et al. | 432/227 |
| 3,948,215 | 4/1976 | Namiki . | |
| 4,438,321 | 3/1984 | Morau | 355/289 |
| 4,566,779 | 1/1986 | Coli et al. . | |
| 4,627,813 | 12/1986 | Sasaki | 355/290 |

FOREIGN PATENT DOCUMENTS

| | | | |
|---|---|---|---|
| 295901 | 12/1988 | European Pat. Off. . | |
| 59-68766 | 4/1984 | Japan . | |
| 63-56662 | 3/1988 | Japan . | |
| 0262671 | 10/1988 | Japan | 355/289 |
| 8501717 | 1/1987 | Netherlands | 355/285 |
| 1034005 | 8/1983 | U.S.S.R. | 355/285 |

*Primary Examiner*—A. T. Grimley
*Assistant Examiner*—T. A. Dang
*Attorney, Agent, or Firm*—Fitzpatrick, Cella, Harper & Scinto

[57] ABSTRACT

An image fixing apparatus includes a heater; a film movable while being in contact with a recording material carrying a toner image, wherein the toner image is heated by heat from the heater through the film; wherein the film and the recording material are separated when a temperature of the toner image is lower than a maximum temperature provided by the heater and is higher than a glass transition point of the toner.

35 Claims, 20 Drawing Sheets

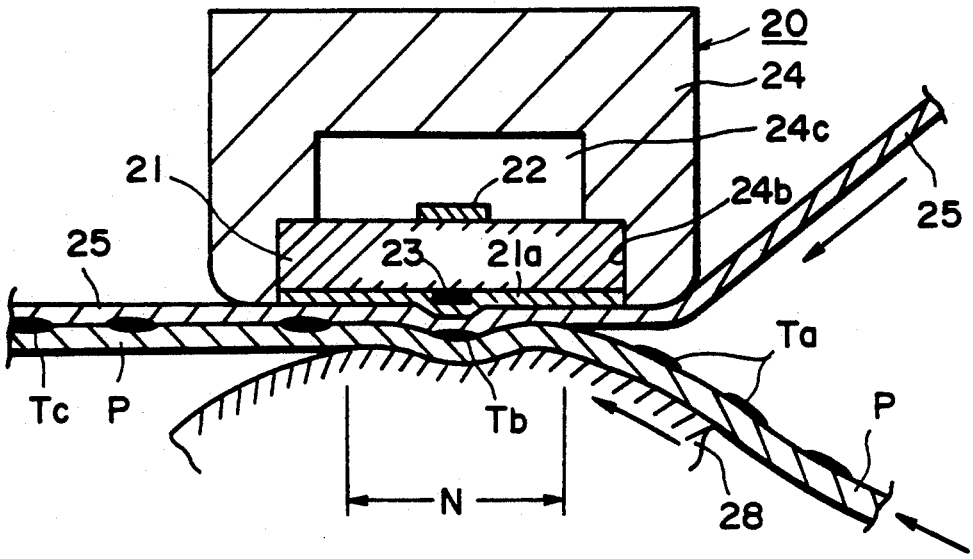
FIG. 9
FIG. 10A
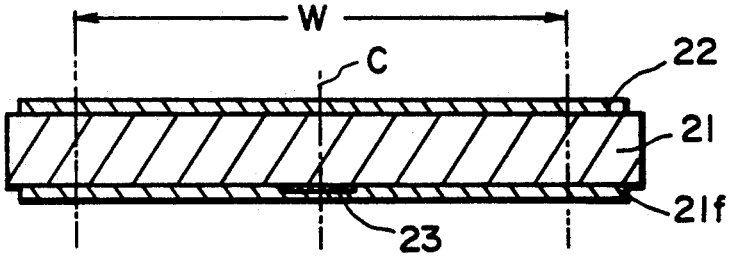
FIG. 10B
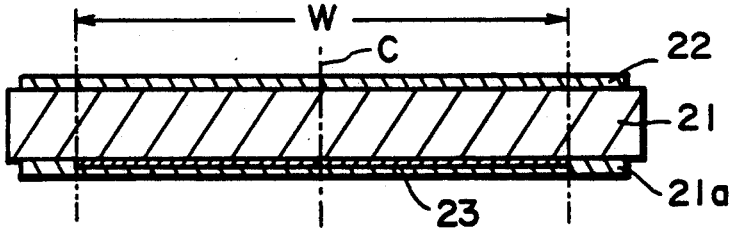
FIG. 10C
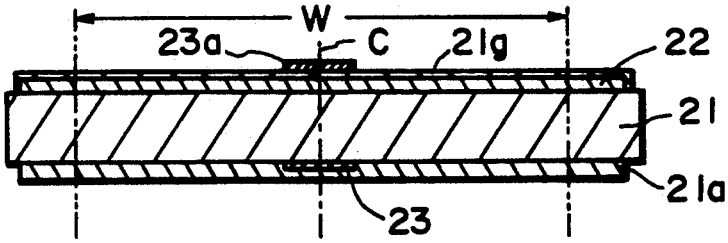

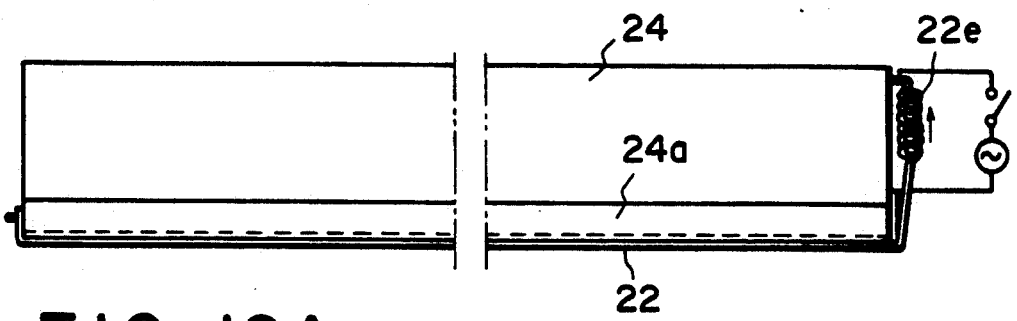
FIG. 19A
FIG. 19B
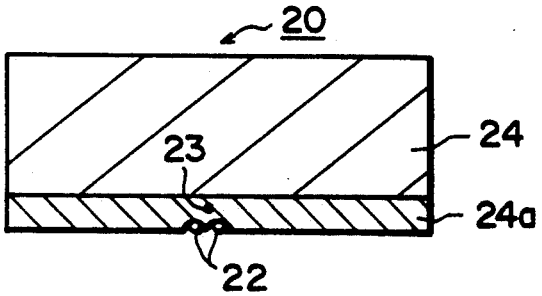
FIG. 20
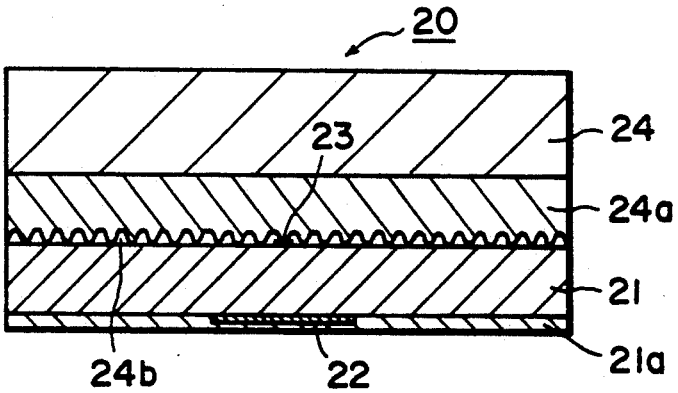
FIG. 21
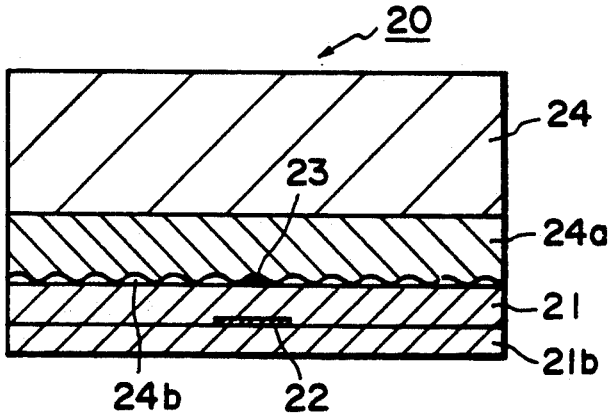

IMAGE FIXING APPARATUS

FIELD OF THE INVENTION AND RELATED ART

The present invention relates to an image fixing apparatus for fixing a toner image on a recording material usable with an image forming apparatus such as a copying machine or a light printer, more particularly to an image fixing apparatus wherein the toner image is heated through a film.

In a widely used conventional image fixing apparatus wherein the toner image is fixed on the recording material supporting an unfixed toner image, the recording medium is passed through a nip formed between a heating roller maintained at a predetermined temperature and a pressing or back-up roller having an elastic layer and press-contacted to the heating roller.

The conventional image fixing system of this type requires that the heating roller is always maintained precisely at an optimum temperature to prevent high temperature off-set and low temperature off-set.

In order to avoid sudden temperature change of the heating roller, the heating roller is required to have a large thermal capacity, with the result that the warming period until the temperature reaches the predetermined level is long.

U.S. Pat. No. 3,578,797 proposes that the toner image is heated and fused while it is in contact with a web, and the web is peeled therefrom after the toner image is cooled to a sufficient extent.

Japanese Patent Publication No. 29825/1976 proposes an fixing system wherein an image supporting material carrying thereon a toner powder image is pressed between heating members to heat the powder image beyond the toner fusing point, and thereafter, the heating is stopped to forcedly cool it, and wherein the image supporting member is separated from the heating members when the temperature of the toner powder image becomes equal to or lower than glass transition point.

U.S. Ser. No. 206,767 which has been assigned to the assignee of this application proposes that a thin film having a low thermal capacity and a heater are used to remarkably reduce the warming period. If the toner image is separated from the film after the toner is sufficiently cooled, more particularly, after the temperature becomes equal to or lower than the glass transition point, the toner has completely lost a rubber-like nature, and therefore, the surface property of the toner image follows the surface of the film with the result that the surface of the fixed toner image becomes glossy, thus deterioration the image quality.

When the toner is cooled to equal to or less than the glass transition point, the toner image itself is solidified with the result of increase of the binding force, and simultaneously therewith, the bonding force between the toner and the belt is also significantly increased. Therefore, when the toner is separated from the film, the toner remains on the film or belt surface as a large mass with the result of liability of the image quality deterioration. There is a liability that the belt sticks to the recording material. In order to prevent the sticking, sharp separation is required.

SUMMARY OF THE INVENTION

Accordingly, it is a principal object of the present invention to provide an image fixing apparatus wherein the high temperature toner off-set is not produced even if the toner is fused at a very high temperature.

Another object of the present invention is to provide an image fixing apparatus which can produce a fixed toner image which is not glossy.

It is a further object of the present invention to provide an image fixing apparatus by which the film and the toner can be separated while the temperature of the toner is higher than the glass transition point. These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 9 is a sectional view of an example of a heater.

FIGS. 10A, 10B, and 10C show examples of temperature sensor positions of the heater.

FIGS. 19A and 19B are a side view and an enlarged sectional view of a heater in a further example.

FIGS. 20–23 are enlarged sectional views of further examples.

DESCRIPTION OF THE PREFERRED EMBODIMENTS

Figure 1:
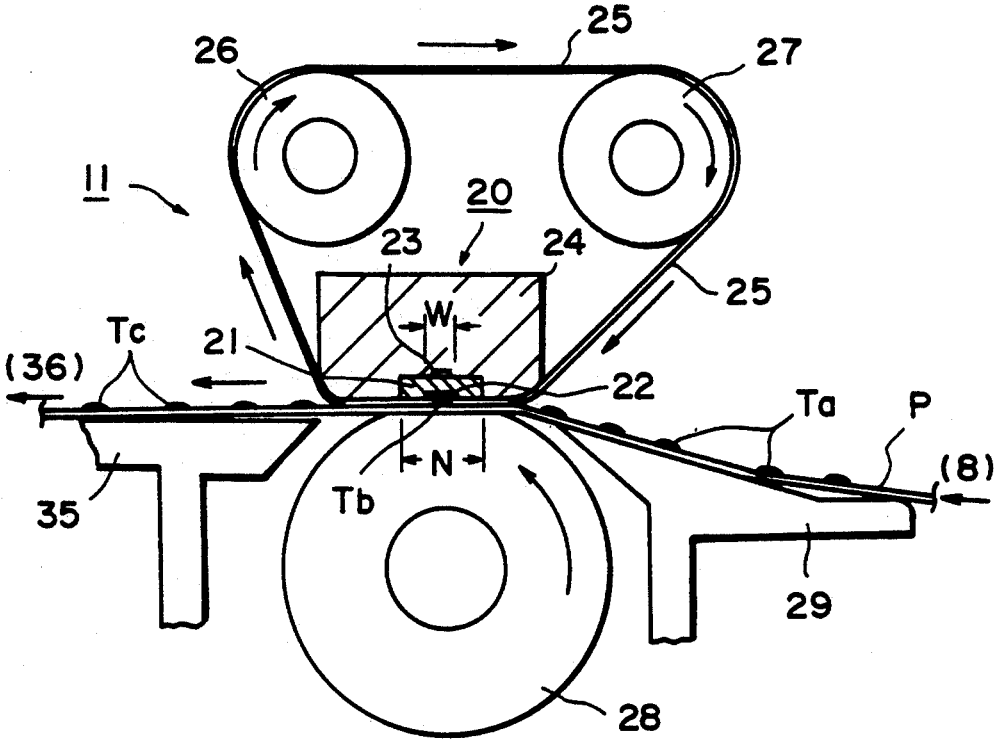
FIG. 1 is a sectional view of an image fixing apparatus according to an embodiment of the present invention.

The preferred embodiments of the present invention will be described in conjunction with the accompanying drawings wherein like reference numerals are assigned to the elements having the corresponding functions.

Figure 4:
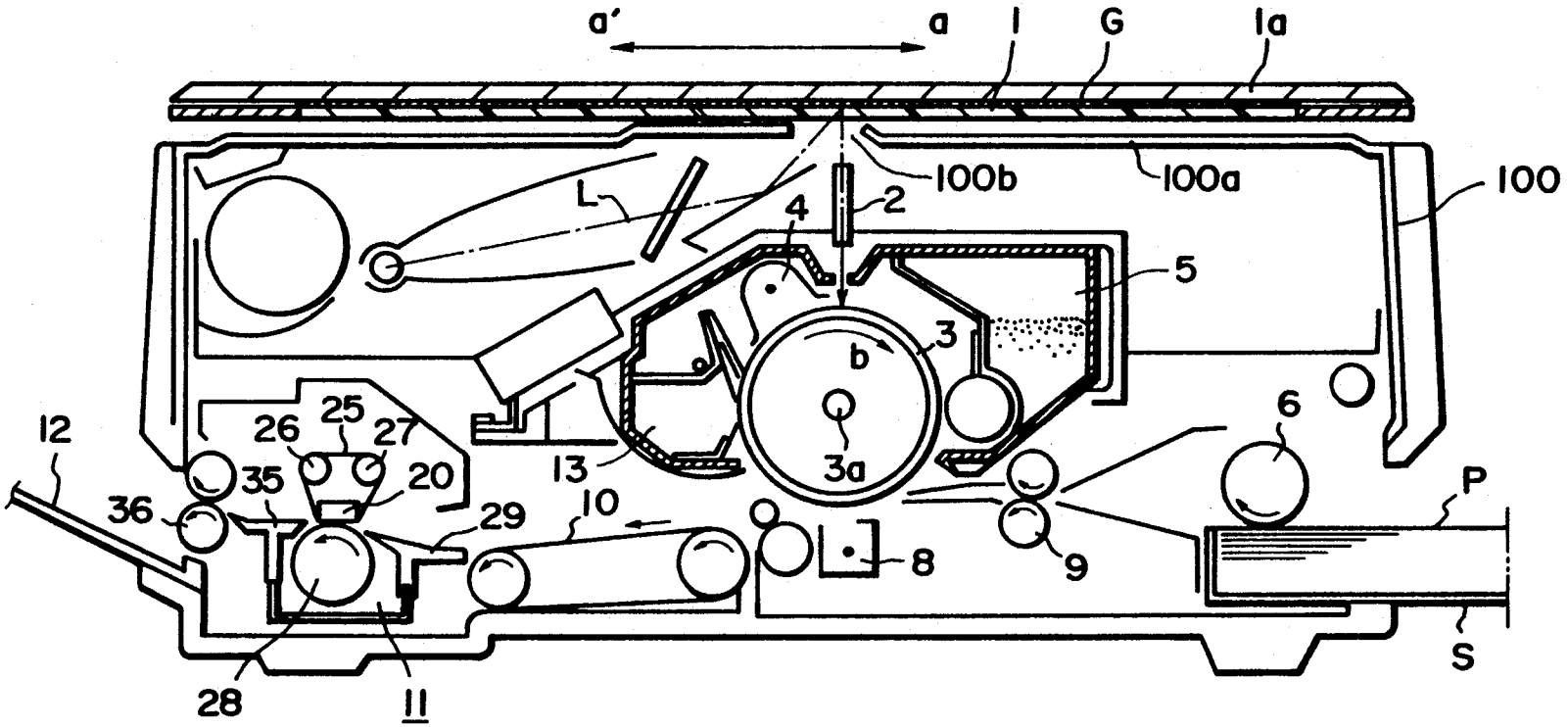
FIG. 4 is a sectional view of an image forming apparatus including an image fixing apparatus according to an embodiment of the present invention.

Referring first to FIG. 4, there is shown an image forming apparatus containing an image heating and fixing apparatus 11 according to an embodiment of the present invention. The image forming apparatus in this embodiment is an electrophotographic copying machine wherein an original supporting platen is reciprocable, which includes a rotatable drum and which is of an image transfer type.

As shown in FIG. 4, the image forming apparatus comprises a casing 100, an original supporting platen 1 of a reciprocable type including a transparent member made of glass plate or the like on a top plate 100*a* of the casing 100, wherein the original supporting platen is reciprocable on the top plate 100*a* in the rightward direction a and in the leftward direction a' at the predetermined speeds.

Designated by a reference G is an original to be copied, it is placed face-down on the top surface of the original supporting platen at a predetermined original reference position, and is covered by an original pressing plate 1*a*.

A slit opening 100*b* is formed in the top plate 100*a*, extending in a direction perpendicular to the reciprocal direction of the original supporting platen 1 (perpendicular to the sheet of the drawing). The image surface of the original G on the original supporting platen 1 passes gradually by the slit opening 100*b* from its right side during the rightward stroke a of the reciprocable movement. During the passage, the original is scanned by light L from a lamp 7 through a slit opening 100*b* and through the transparent original supporting platen 1. The light reflected by the scanning illumination light is formed on a surface of a photosensitive drum 3 through an array 2 of short focus and small diameter imaging elements.

The photosensitive drum 3 has a coated photosensitive member made of a photosensitive material such as zinc oxide or organic photoconductor, and is rotatable in the clockwise direction b at a predetermined speed about a central shaft 3*a*. During the rotation, it is uniformly charged to a positive or negative polarity by a charger 4. The surface having been uniformly charged is exposed to the light image of the original (slit exposure), so that an electrostatic latent image is formed on the photosensitive drum 3.

The electrostatic latent image is developed by a developing device 5 into a visualized image with toner made of resin which is softened or fused by heating and other material or materials. The toner image (visualized image) is advanced to an image transfer station having an image transfer discharger 8.

The transfer material sheets P (recording material) are accommodated in a cassette S. From the cassette, the sheets are fed out one by one by a pick-up roller 6. The sheet P is then fed to the transfer discharger 8 by the registration roller 9 in such a timed relation that when the leading edge of the toner image on the drum 3 reaches the transfer discharger 8, the leading edge of the transfer material sheet P reaches the transfer discharger 8 so that they are aligned. Then, the toner image is transferred from the photosensitive drum 3 onto the fed sheet by the transfer discharger 8.

The sheet having received the toner image is separated from the photosensitive drum 3 by an unshown separating means, and is conveyed to a fixing device 11 by a conveying device 10. In the fixing device 11, which will be described in detail hereinafter, the unfixed toner image is heated and fixed, and finally, it is discharged onto the discharge tray 12.

The surface of the photosensitive drum 3, after the toner image is transferred, is cleaned by a cleaning device 13, by which the residual toner remaining on the photosensitive drum and the contamination are removed, so that it is prepared for the next image forming operation.

The fixing device 11 in this embodiment will be described in detail.

FIG. 1 is an enlarged view of the fixing device 11 incorporated in the image forming apparatus of FIG. 4. An endless fixing film 25 is stretched around a left side driving roller 26, a light side follower roller 27 and a low thermal capacity linear heater 20 fixed at a lower position between the rollers 26 and 27, the rollers 26 and 27 and the heater 20 being extended parallel to each other.

The follower roller 27 functions as a tension roller for applying tension to the endless fixing film 25. When the driving roller 26 rotates in the clockwise direction, the fixing film 25 is rotationally driven without crease, snaking movement and delay, at a peripheral speed which is substantially the same as the transfer sheet P having thereon the unfixed toner image Ta supplied from the image forming station 8.

A pressing roller 28, functioning as a member for urging the sheet, has a rubber elastic layer having a good releasing property, made of silicone rubber or the like. It presses the bottom travel of the endless fixing film 25 to the bottom surface of the heater 20, by an unshown urging means, with the total pressure of 4–7 kg. It rotates in the same peripheral direction as the transfer sheet P, that is, in the counterclockwise direction.

Since the endless fixing film 25 is repeatedly used for the heat-fixing the toner image, it is good for heat resistivity, the releasing property and the durability. Generally, it has a thickness of not more than 100 microns, preferably not more than 50 microns. It is a single layer film made of heat resistive resin such as polyimide, polyetherimide, PES or PFA (copolymer of tetrafluoroethylene and perfluoroalkylvinyl ether), or a compound layer film including a film having a thickness of 20 microns and a releasing coating layer of 10 microns, at least at the image contacting side of the film, including fluorinated resin such as PTFE (tetrafluoroethylene resin) or PFA resin and conductive material added thereto.

A heater supporting member 24 is heat-resistive, and provides the entire mechanical strength of the heater 20. It is made of a highly heat-resistive resin such as PPS (polyphenylene sulfide), PAI (polyamide imide), PI (polyimide), PEEK (polyether ether ketone) or liquid crystal polymer, or a compound material including such a resin and ceramic material or glass.

A base plate 21 for the heater is, for example, an alumina base plate having a thickness of 1.0 mm, a width of 9 mm and a length of 240 mm. A heat generating element 22 is in the form of a line or stripe having a low thermal capacity. It has, for example, a width of 1.0 mm and is extended along the length of the base plate 21 substantially at the middle thereof. It is made of, for example, $Ta_2N$ or other electric resistance material which generates heat upon electric energization. A temperature detecting element 23, for example, is a low thermal capacity temperature measuring resistor such as Pt film applied by screen printing or the like along the length substantially at the center of the top surface (opposite from the surface having the heat generating element 22) of the base plate 21.

The alumina base plate 21 has a good thermal conductivity so that it shows a temperature quickly responding to the temperature change of the heat generating element 22. The temperature detecting element 23 detects the temperature of the alumina base plate 21, and feeds it back to the heat generating element, so that the peak temperature upon energization, of the heat generating element 22 is maintained substantially constant.

In this embodiment, the linear or stripe heat generating element 22 is supplied with electric power by the electric connections at the longitudinal ends to generate heat along the entire length of the heat generating element 22. The energization is performed through an energization control circuit so that DC 100 V pulses are applied at the period of 20 msec with the pulse width being changed in accordance with the temperature detected by the temperature detecting element 23 and the energy radiation. The pulse width is controlled with the range of 0.5–5 msec, and the heatgenerating element 22 is instantaneously heated up to 200°–300° C. each time the pulse is applied. In this embodiment, there is a sensor (not shown) for sensing the leading and trailing edges of the sheet adjacent to the fixing device at its upstream side with respect to the transfer sheet conveyance direction. Using the detection signal by the sensor, the energization period for the heat generating element 22 is limited to the period in which the sheet P is passing through the fixing device 11.

Figure 3:
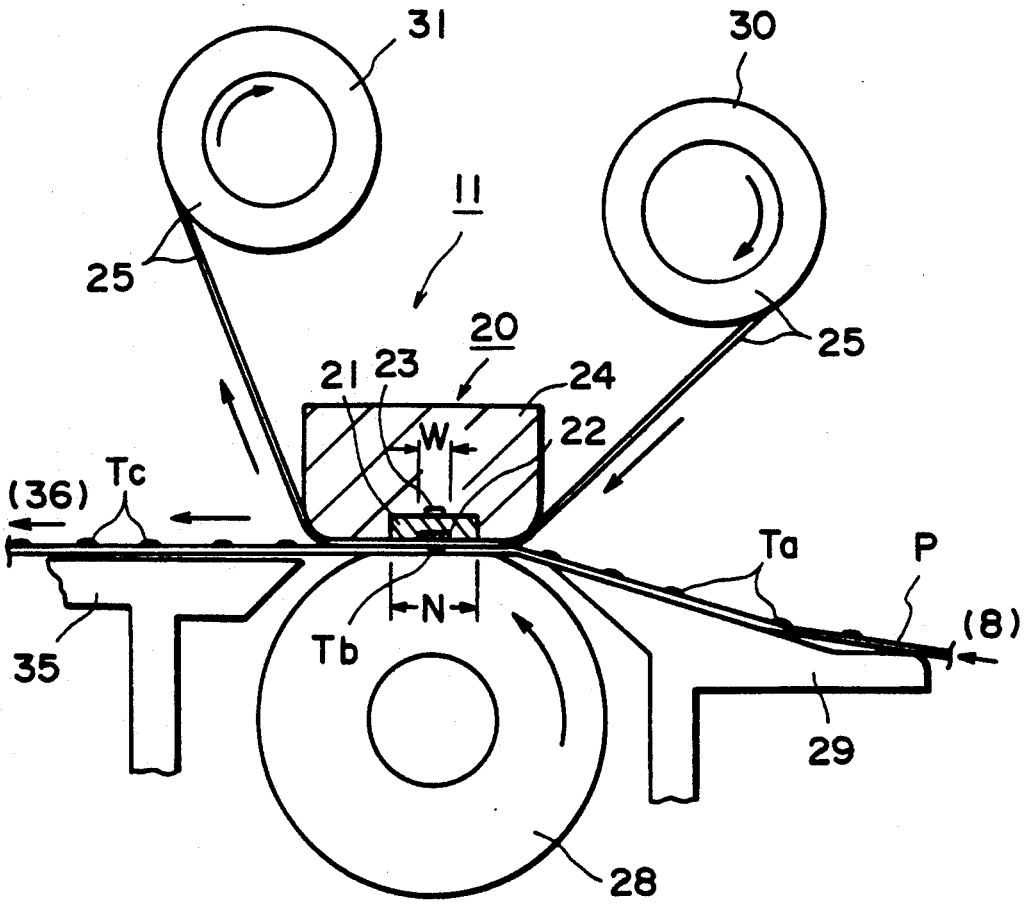
FIG. 3 is a sectional view of an image fixing apparatus according to another embodiment of the present invention.

The fixing film 25 is not limited to the endless belt. As shown in FIG. 3, it may be a non-endless film rolled on a supply shaft 30 which is extended to the take-up shaft by way of the heater 20 and the pressing roller 28. The film is travels from the supply shaft 30 to the take-up shaft 31 at the same speed as the transfer sheet P.

An operation of the apparatus of FIG. 1 embodiment will be described. Upon image formation start signal, the image forming apparatus forms an image and feeds the sheet from the transfer station 8 to the fixing device 11. When the leading edge of the sheet P having the unfixed toner image Ta on its top surface is detected by the sensor (not shown) disposed adjacent to the fixing device, the fixing film 25 starts to rotate or travel. The transfer sheet P is guided along the guide 29, and is introduced into the nip N (fixing nip) between the fixing sheet 25 and the pressing roller 28, by which the toner carrying side of the sheet P is closely contacted to the bottom surface of the fixing film moving at the same speed as the sheet P, and they are passed together through the nip without surface deviation or crease.

Figure 2:
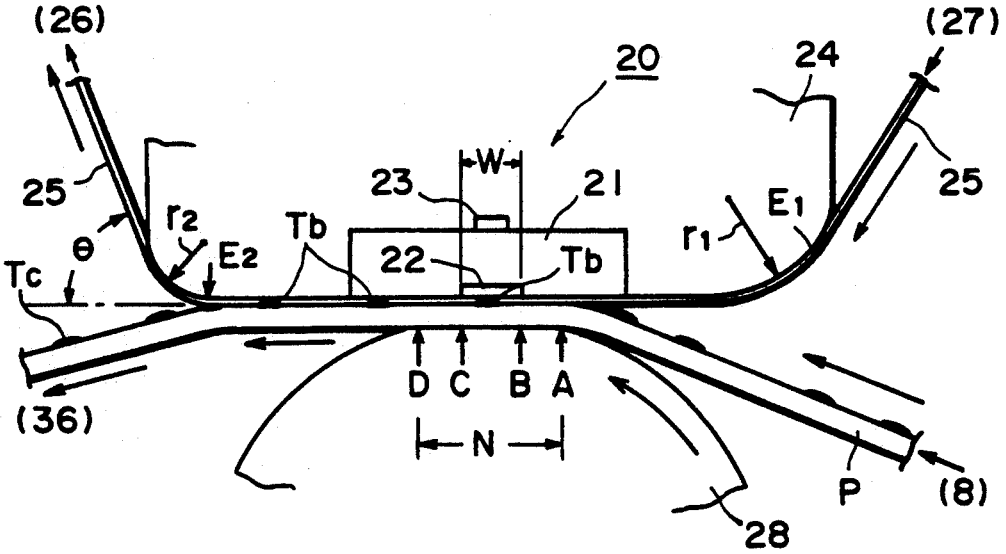
FIG. 2 is an enlarged view of a nip in the image fixing apparatus of FIG. 1.

FIG. 2 is a schematic enlarged cross section of the bottom surface of the heater including the nip between the heater 21 and the pressing roller 28.

The bottom surface which is in sliding contact with the fixing film 25 is rounded at the front end E1 and back end E2 of the supporting member 24. The radii are $r_1$ and $r_2$, respectively. The fixing film 25 advances smoothly to the bottom surface of the heater along the rounded front end E1 from the follower roller 7 and is further advanced in sliding contact with the bottom surface of the heater. Then, it is deflected toward the driving roller 26 upwardly with a large deflection angle $\theta$ along the rounded back end E2.

The heat generating element 22 has a width W which is within the fixing nip N formed between the bottom surface of the heater 20 and the pressing roller 28.

Reference characters A, D, B and C are an upstream end of the width of the fixing nip N with respect to the direction of the travel of the fixing film, a downstream end thereof, an upstream end of the width W of the heat generating element, and a downstream end thereof.

(1) The unfixed toner image Ta on the transfer sheet P introduced into the fixing device 11 enters the fixing nip N at the position A and starts to receive heat from the heater 20 through the fixing film 25.

(2) When it is passing by the heater 22 from the position B to the position C, the temperature of the toner is highest, so that the toner is completely fused (high temperature fusing), and is fuse-bonded on the sheet P surface. In this region where the toner is directly under the heat generating element 22, the toner temperature is so high that the high temperature toner off-set is possible.

(3) During the period in which the toner image passes from the position C to the position D after passing through the portion of the heat generating element 22, the bottom surface temperature of the heater 20 is lower than the temperature thereof between the position B and the position C, so that the temperature of the toner Tb decreases, by which the toner viscosity increases as compared with that in the position between the positions B and C.

(4) When the toner image passes in the region from the position D which is the end of the fixing nip N and the rounded back end E2 of the bottom surface of the heater, the sheet P is conveyed while adhered to the bottom surface of the fixing film 25 by the adhesive nature of the softened toner Tb.

During the period in which the toner reaches the rounded end E2, the temperature of the toner further decreases, and it becomes outside the high temperature offset region. However, the temperature of the toner is higher than the glass transition point of the toner.

(5) At the rounded end E2 of the heater 20, the fixing film 25 deflects toward the driving roller 26 with the large deflection angle $\theta$ around the rounded back end E2 having the small radius of curvature $r_2$. That is, the fixing film is deflected so that it is quickly away from the sheet P surface. The rigidity of the sheet P overcomes the bonding force of the sheet P to the fixing film 25, by which the sheet P and the fixing film 25 are separated at the rounded back end E2 (separation position).

As described, at the separating position, the temperature of the toner Tb is higher than the glass transition point, and therefore, the bonding force between the sheet P and the fixing film 25 is small at the separation point, and the toner is heated sufficiently up beyond the toner fusing point in the region between the positions B and C and is completely fused. For those reasons, the sheet P is always smoothly separated without hardly any toner offset to the fixing film 25 and without the sheet P sticks to the fixing film 25 and with the resultant jamming.

The toner Tb at the temperature higher than the glass transition point has proper rubber characteristics so that the toner image at the separating point does not follow the surface of the fixing film, and therefore, it has a sufficiently rough surface property. Then, the toner is cooled and solidified without changing the surface property. Therefore, the toner image fixed is not glossy, and has a high quality.

(6) The sheet P separated from the fixing film 25 is guided by the guide 35 and is conveyed to the couple of discharging rollers 36. During the conveyance, the temperature of the toner Tb decreases from the temperature higher than the glass transition point by spontaneous cooling, and becomes lower than the glass transition point, and is solidified into a solidified toner image Tc. The sheet P thus having the fixed toner image is discharged to the tray 12.

As an actual example, a toner mainly made of a thermoplastic resin and having a glass transition point of 50° C. and a fusing point of 130° C. was used. The good results were obtained when the surface temperature of the fixing film at the position A was 110° C.; the temperature was 150° C. in the region between the positions B and C; the temperature was 130° C. at the position D; and the temperature was 100° C. at the position E2 (separating position). Between the positions D and E2, the temperature of the toner Tb is maintained higher than the glass transition point of the toner, more particularly between the glass transition point and the fusing point, so that the toner Tb is in the form of rubber, thus providing proper adhesiveness with the film 25.

The radius of curvature at the sheet separating position, that is, the radius of curvature $r_2$ of the rear rounded end E2 of the bottom surface of the heater is preferably 0.5–10 mm, and further preferably not more than 5 mm. The deflection angle $\theta$ of the film 25 is not less than 5 degrees, preferably, not less than 25 degrees.

In this embodiment, the linear heat generating element 22 of the heater 20 is instantaneously heated upon energization to a sufficiently high temperature in consideration of the toner fusing point (or fixable temperature), and therefore, it is not necessary to keep the heat generating element energized during the stand-by state of the apparatus. Therefore, only little heat is transferred to the pressing roller 28 when the fixing operation is not carried out. During the fixing operation, in the fixing nip N between the heater 20 and the pressing roller 28, the fixing film, the toner image and the sheet P are disposed, and the heating period is short. For those reasons, there exist a steep temperature gradient. Therefore, the pressing roller 28 is not easily heated, and therefore, the temperature thereof is maintained lower than the toner fusing point even when a practical continuous image forming operation is performed. In the apparatus of this embodiment, the toner image made of the heat-fusible toner on the sheet P is first heated and fused by the heater 20 through the fixing film, and particularly, the surface layer of the toner is completely softened and fused. At this time, the heater, the fixing film, the toner image and the sheet are urged by the pressing roller 28, so that the heat is efficiently transferred. By this, the toner image can be efficiently heated and fused with minimum heating of the sheet P itself. In addition, the energization period is limited. For those reasons, the energy consumption can be saved. The size of the heater may be small, and therefore, the thermal capacity may be small. Therefore, it is not necessary to pre-energize the heater during the stand-by period. The power consumption during the non-fixing-operation can be reduced, and in addition the temperature rise within the apparatus can be prevented.

In this embodiment, the toner temperature at the separating point is higher than the glass transition point. However, it is further preferable that the temperature is higher than the fusing point ring and ball softening point. This is effective to prevent the toner offset and to suppress the gloss, which is confirmed by the inventors' experiments.

It is preferable that the toner temperature at the separating point is lower than the fusing point to increase the coagulation force.

When the toner has a plurality of glass transition points, the glass transition point when it is said that the toner temperature at the separating point is higher than the glass fusing point, means the maximum glass fusing point, in order to prevent the existence of the portion which has lost the rubber property.

Figure 5:
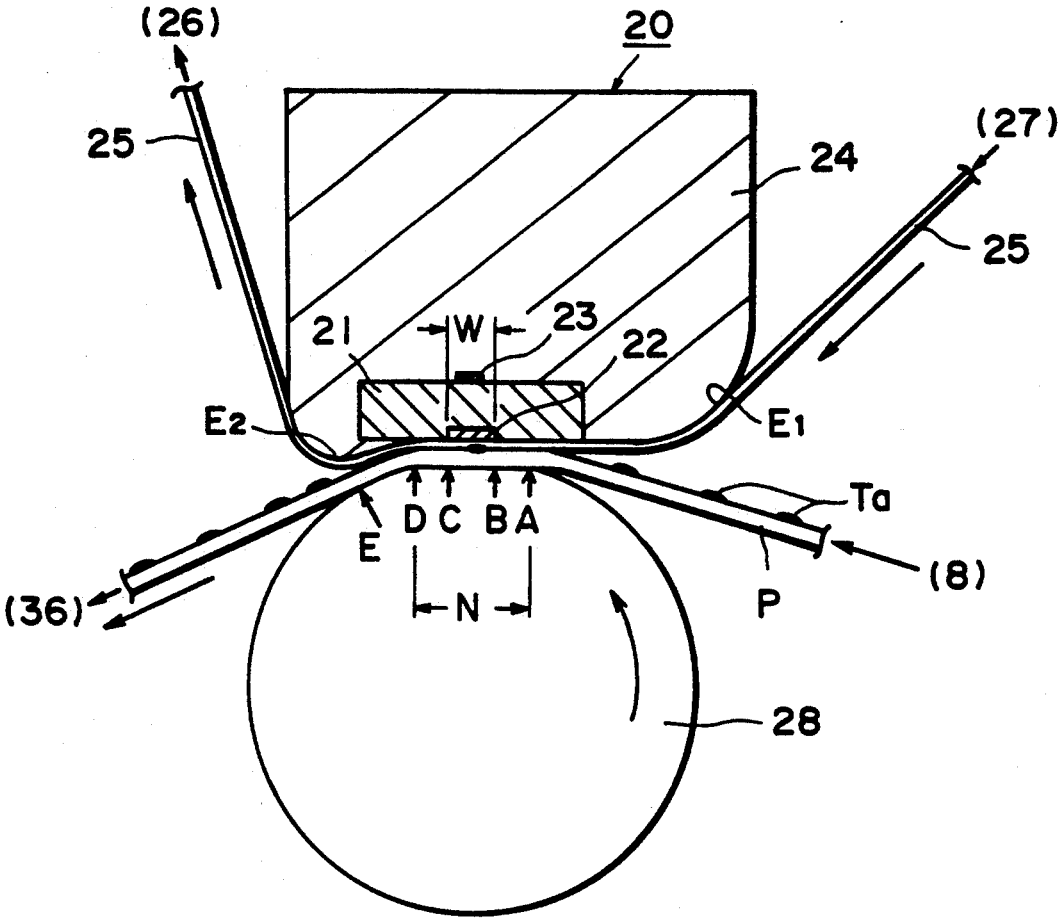
FIGS. 5–8 are sectional views of fixing apparatuses according to further embodiment of the present invention.

Referring to FIG. 5, another embodiment of the present invention will be described. In this embodiment, the rounded rear end E2 of the bottom surface of the heater 20 is projected downwardly toward the pressing roller 28.

By doing so, after the sheet P passes through the fixing nip N (between the positions A and D), sheet P is lightly urged to the surface of the pressing roller 28 by the downward projected portion E2 of the bottom surface of the heater until the fixing film 25 is separated from the sheet.

(1) Therefore, the close contact between the fixing film 25 surface with the sheet P and the toner image Tb is assured from the rear end position D of the fixing nip N to the rounded rear end E2 of the heater. In the first embodiment (FIG. 2), when the amount of the toner on the sheet P is significantly small, the bonding force by the softened toner Tb between the sheet P and the fixing film 25 is significantly small, so that the sheet P is separated from the fixing film 5 by the gravity while it moves from the position D to the separating position E, with the result of possible unstable sheet conveyance. With the structure of this embodiment, even if the amount of the toner is significantly small, the sheet conveyance to the separating position E is stabilized, so that the sheet P is first separated from the fixing film 25 surface at the separating position E, and therefore, the sheet conveyance is stabilized.

In this embodiment, the sheet is stably conveyed without significantly relying on the bonding force between the toner and the film. Therefore, the temperature of the heater can be increased so that the fixing property is improved beyond the first embodiment. In this embodiment, the surface temperature of the fixing film in the region directly below the heat generating element, that is, the region between the positions B and C is 180° C. which is higher than in the first embodiment (150° C.). By doing so, the surface temperature of the fixing film at the position D is 160° C. which is higher than the toner fusing point (130° C.). Between the position D and the separating position E, the toner image Tb and the sheet P are conveyed between the pressing roller 28 and the supporting member 24 of the heater 20 while stably contacted to the fixing film 25 surface, and therefore, the heat of the toner is transferred to the pressing roller 28 or to the supporting member 24. When it reaches the separating position E, the temperature of the toner is 90° C. which is between the toner fusing point (130° C.) and the glass transition point of the toner (50° C.). Therefore, the sheet P is smoothly separated from the surface of the fixing film 25 without the toner offset or adherence to the fixing film 25. This permits to increase the temperature of the heater to stabilize the fixing performance.

When the toner is made of such material as to provides sufficient coagulation even under the temperature higher than its fusing point, it is possible that the temperature of the toner at the separating point is slightly higher than the fusing point.

Figure 6:
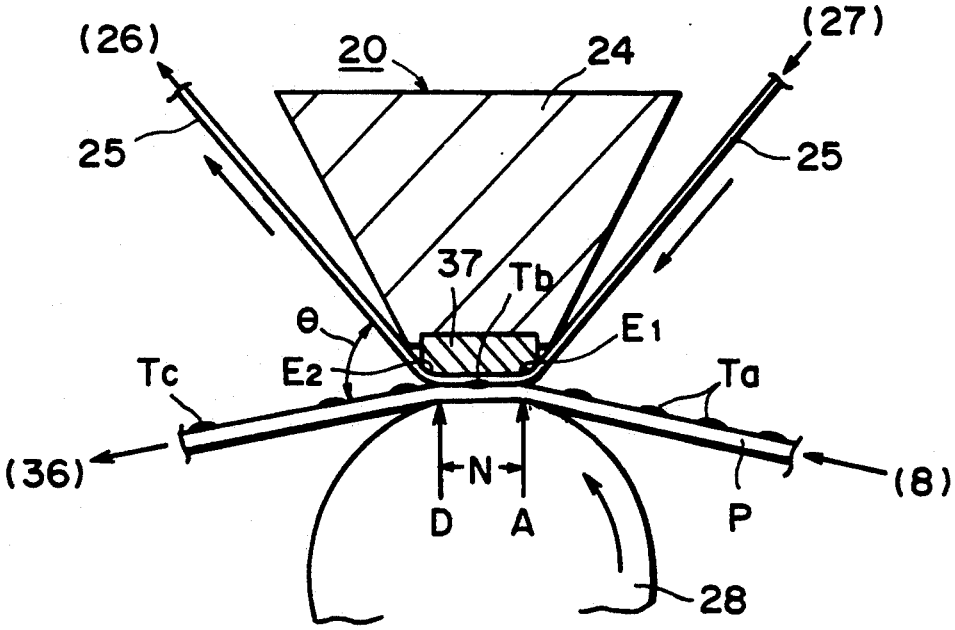

Referring to FIG. 6, a further embodiment of the present invention will be described. In this embodiment, the heat generating element of the heater 20 is made of a ceramic base plate 37 having such a PTC property that the electric resistance thereof steeply increases at a temperature higher than 180° C. Therefore, the temperature is self-controlled at 180° C. The surface temperature of the fixing film between the positions A and D, that is, in the region of the fixing nip N, is approximately 170° C. The glass transition point of the used toner is 60° C., and the fusing point is 150° C. The toner has sufficient coagulation force even if it is beyond the fusing point. The rear end D of the fixing nip N is the separating point, and the rear end E2 of the ceramic base plate 37 is rounded with a radius of curvature of 2 mm. The deflection angle $\theta$ of the fixing film 25 at the separating point D is 50 degrees.

The toner Tb heated beyond the fusing point in the fixing nip N is separated from the fixing film 25 surface at the separating position D by the deflection.

The temperature of the toner at the time of the separation is not less than the fusing point. Still, however, the coagulation of the toner itself is sufficiently large, so that the toner Tb is separated from the fixing film 25 surface together with the sheet P, and therefore, the amount of the toner remaining on the fixing film 25 surface is small.

Figure 7:
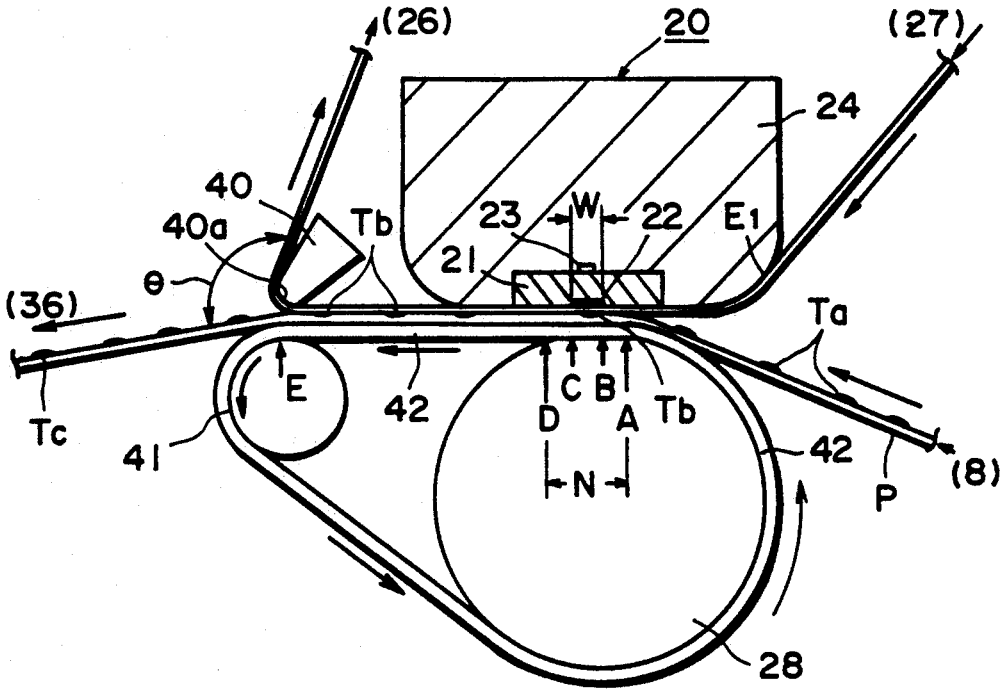

Referring to FIG. 7, a further embodiment will be described. In this embodiment, the structure of the heater 20 is same as in the first embodiment in this embodiment, a fixing film guiding member 40 and a small roller 41 are disposed downstream of the heater 20 and the pressing roller 28, respectively, with respect to the sheet conveyance direction. The fixing film 25 is deflected upwardly from the bottom surface of the heater 20 by way of the leading edge of the guiding member 40. Between the pressing roller 28 and the small roller 40, a conveying belt 42 made of silicone rubber with base cloth having a thickness of 500 microns is stretched. The small roller 41 is effective to rotationally drive the belt 42. The guiding member 40 functions as a separating member. The radius of curvature of the bottom edge 40*a* around which the fixing film 25 is deflected is 1 mm, and the deflection angle $\theta$ is 120 degrees.

The fixing nip N is defined by the heater 20 and the pressing roller 28 sandwiching the fixing film 25 and the conveying belt 42. The toner image Ta on the sheet P introduced is heated by the fixing nip N, that is, between the positions A and D. Thereafter, the sheet P is conveyed while being supported by the conveying belt 42 so that it is urged to and closely contacted to the bottom surface of the fixing film 25 until it reaches the bottom end of the guiding member 40 at the separating position E. At the separating position E, it is deflected and separated from the film 25. The toner Ta used in this embodiment has the glass transition point of −10° C., the fusing point of 70° C. It is made mainly of wax resin. The viscosity thereof steeply decreases when the temperature is higher than 70° C., that is, it has a so-called sharp melting property. The surface temperature of the fixing film directly under the heat generating element 22, that is, between the positions B and C, is 100° C. which is far beyond the toner fusing point, so that the toner Ta is completely fused and is strongly bonded on the surface of the sheet P.

The surface temperature of the fixing film at the position D is 90° C., and the viscosity of the toner is still significantly low. During the period in which the toner Tb is conveyed to the separating position E, it is cooled by radiation down to 55° C. which is between the fusing point 70° C. and the glass transition point −10° C., so that the coagulation force of the toner is sufficiently high. Therefore, it is separated by deflection from the film 25 in good order without the toner remaining on the fixing film 25 at the separating position E. According to this embodiment, even if the toner has the sharp melting property, the high temperature off-set of the toner does not result, because the sheet is conveyed assuredly to the separating position E with the contact between the toner and the film maintained until the toner temperature becomes lower than the fusing point.

Figure 8:
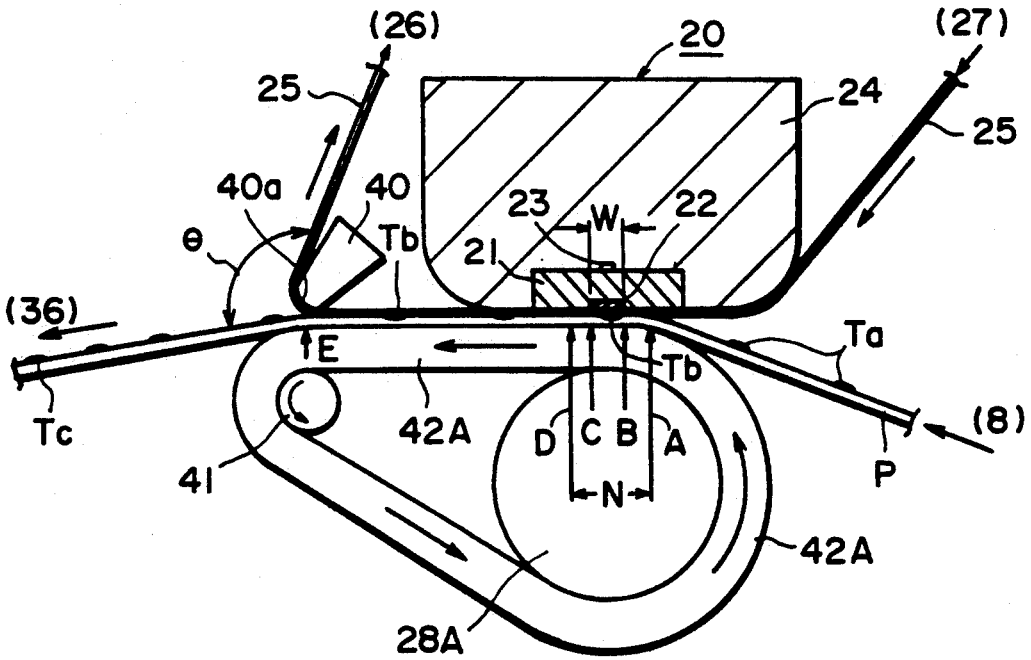

Referring to FIG. 8, a further embodiment will be described. In this embodiment, the conveying belt is a silicone rubber belt 42*a* having a thickness of 3 mm, and in place of the pressing roller (28) a core metal 28A is used.

Since the belt 42A has a high rigidity so that it provides a strong urging force for urging the toner Tb to the bottom surface of the fixing film 25. Therefore, there is no liability that the toner having passed through the fixing nip N is separated from the film surface before reaching the separating point E.

The base plate 21 of the heater 20 may be, in addition to the alumina, a heat resistive glass, or heat resistive resin such as PI or PPS. The material of the heat generating element 22 may be, in addition to $Ta_2N$, nichrome $RuO_2$, Ag-Pd or another resistor. The temperature detecting element 23 may be made of a bead thermister having a low thermal capacity in place of the temperature detecting resistor such as Pt film. The bottom surface of the heater with which the fixing film 25 is in sliding contact is preferably provided with a protection layer such as a heat-resistive glass layer for protection from the sliding movement. The heat generating element 22 may be disposed on the top surface of the base plate 21, opposite from the film contacting side of the base plate 21, whereas the temperature detecting element 23 may be disposed at the bottom side of the base plate 21 (opposite from the fixing film contacting side). Further, both of the heat generating element 22 and the temperature detecting element 23 are disposed on the bottom side of the base plate 21. The energization of the heat generating element 22 may be in unusual AC voltage form, in place of the pulse energization.

When the fixing film 25 is a non-endless one, as shown in FIG. 3, a replaceable rolled film can be employed, wherein when almost all of the fixing film is taken-up on the take-up reel, a new roll of film is mounted (a wind-up and exchange type). In this type, the thickness of the fixing film can be reduced substantially irrespective of the durability of the fixing film, so that the power consumption can be reduced. For example, the fixing film in this case may be made of a less expensive material such as PET (polyester) film which is treated for heat-durability having a thickness of 12.5 microns or lower, for example.

Alternatively, in view of the fact that the toner off-set to the fixing film surface is not practically produced, the used fixing film taken-up on the take-up shaft can be rewound on the feeding shaft, or the take-up shaft and the feeding shaft are interchanged to use the fixing film repeatedly, if the thermal deformation or thermal deterioration of the fixing film is not significant (a rewinding and repeatedly using type).

In this type, the fixing film is preferably made of a material exhibiting high heat-resistivity and mechanical strength, such as polyimide resin film having a thickness of 25 microns which is coated with a parting layer made of fluorine resin or the like having a good parting property to constitute a multi-layer film. A press-contact releasing mechanism is preferably provided to automatically release the press-contact between the heater and the pressing roller during the rewinding operation.

Where the fixing film is used repeatedly as in the rewinding type and an endless belt type, a felt pad may be provided to clean the film surface and to apply a slight amount of parting agent such as silicone oil by impregnating the pad with the oil, by which the surface of the film is maintained clean and maintained in good parting property. Where the fixing film is treated with insulating fluorine resin, electric charge is easily produced on the film, the electric charge disturbing the toner image. In that case, the fixing film may be rubbed with a discharging brush which is electrically grounded to discharge the film. On the contrary, the film may be electrically charged by applying a bias voltage to such a brush without grounding as long as the toner image is not disturbed. It is a possible measure against the image disturbance due to the electric charge to add carbon black or the like in the fixing film. The same means is applicable against the electric charge of the back-up roller. As a further alternative, anti-electrification agent may be applied or added.

In any of the endless belt type, the take-up and exchange type and the repeatedly using type, it may be in the form of a cartridge detachably mountable to a predetermined position of the fixing device 11 to facilitate the exchange or the like of the fixing film.

The fixing device of this invention is not limited to an image transfer type electrophotographic copying apparatus, but is applicable to a type wherein a toner image is directly formed and carried on an electrofax sheet or an electrostatic recording sheet or the like, wherein the image is formed and recorded magnetically, or wherein an image is formed with a heat fusible toner on a recording medium by another image forming process and means. An example of such apparatus are heat-fixing type copying machine, laser beam printer, facsimile machine, microfilm reader-printer, display device and recording device. The present invention is applicable to them.

Referring to FIG. 9, a further embodiment of the present invention will be described. In this embodiment, the heater 20 comprises a heater fixing member 24 which is a square elongated member extending in the lateral direction of the fixing film. It is made of a high rigidity, a high heat-resistivity and a low thermal conductivity material such as PPS, polyimide or Bakelite. In another structure of the heater supporting member, the heat resistive and low thermal conductivity material is used in the region contacting to a heater base plate 21 which will be described in detail hereinafter, and the other portion is made of another material.

The heater base plate 21 is an elongated member extending along the bottom surface of the fixing member 24 in the longitudinal groove **24*b*. The heater base plate 21 is made of ceramic material having a good thermal conductivity such as alumina having a length of 240 mm, a width of 10 mm and a thickness of 1.0 mm. On the bottom surface of the base plate 21, a heat generating resistor 22 is formed in a line or stripe along the length thereof at substantially the center. The heat generating resistor 22** is made of nichrome, tungsten, silver-palladium (Ag/Pd), ruthenium oxide ($RuO_2$), $Ta_2N$ or a material mainly composed of such a material (heat generating resistor generating heat upon electric energization). It is applied on the base plate by screen printing or the like with the width of 1.0 mm and the thickness of 20 microns. A surface heat generating element such as ceramic heater or the like may be used.

A low thermal capacity temperature detecting element 23 in the form of a temperature detecting resistor (Pt film), a thermister or the like, is applied by screen printing or implanted on the surface of the base plate 21 which is opposite from the heat generating resistor 22 side of the base plate 21, substantially at the center thereof. It is preferable that the temperature detecting element is within the fixing nip N where the pressing roller 28 is pressed to the heater 20 through a fixing film 24. The surface of the heater base plate 21 including the temperature detecting element 23 is coated with a protection layer **21*a*** the protection layer is made of anti-wearing material such as glass or ceramic material, and it has a small thickness, 10 microns for example.

A cavity **24*c* is formed at least between a rear portion corresponding to the fixing nip N in the surface side of the heater and the heater fixing member. The cavity 24*c* extends along the length of the heater base 21 at least in the region of the maximum size of the transfer sheet usable. The opposite longitudinal ends are closed to shut the convection thermal transfer with the outside thereof by connective heat transfer. The width of the cavity 24*c*** is larger than the width of the heat generating resistor, and further preferably, it is larger than the width of the fixing nip N.

When the electric energy is supplied between the power supply electrodes at the longitudinal opposite ends of the heater 22, the entire length thereof generates heat which heats the base 21 having the good thermal conductivity. The surface temperature of the base 21 is detected by the temperature detecting element 23, and the temperature is fed back to an unshown energization controlling circuit, by which the energization to the heat generating element 22 is controlled to maintain a predetermined constant temperature of the fixing nip.

Since the cavity **24*c* is provided between the rear side of the heater 21 corresponding to the fixing nip N and the heater 21 supporting member 24, the heat of the heater 21 is prevented from wastefully transferring to the supporting member 24 from the rear side of the heater by the heat insulating function of the air in the cavity 24c. Therefore, the ratio of the heat quantity from the surface of the heater to the fixing film 25 through the fixing nip N to the total heat of the heater 21, increases. Therefore, the thermal efficiency is increased, by which the energy consumption required for fixing the image is reduced. Using the heater having such a cavity 24c and a heater without using the cavity and the entirety of the backside of the heater 21 being contacted to the supporting member 24, the fixing operations were performed under the same conditions. The electric power required for fixing the toner on the transfer sheet P immediately after the fixable state is reached from the room temperature condition, was only 60% of the electric power required by the heater without the cavity 24c**. Therefore, 40% save of the energy was achieved.

This is because the thermal conductivity of the air in the cavity 24c is only 0.03 W/m.deg which is far smaller than 0.2 W/m.deg which is the thermal conductivity of the polyimide resin constituting the heater fixing member 24, and therefore, the ratio of the heat transferred to the surface of the heater 21, that is, to the fixing film to the heat generated by the heat generating resistor is increased.

In this embodiment (FIG. 9), the temperature detecting element 24 is disposed within the fixing nip N on the surface side of the heater 21. This is firstly because it is preferable in order to increase the accuracy of the temperature control of the heater 20 to detect directly and real time the temperature of the fixing nip N, that is, the surface side temperature of the heater base 21, and secondary because the heater of this embodiment is provided with the cavity 24c at the heater surface side to provide the air insulation, and therefore, the heat radiation speed at the backside of the heater is lower than that at the heater front surface side providing the fixing nip N, with the result of the possibility of the temperature difference between the front side temperature and the backside temperature of the heater.

FIGS. 10A, 10B and 10C show examples of the dispositions of the temperature detecting elements 23. Reference characters C and W indicate the center line of the passage of the sheet, and the maximum sheet passage width, respectively. The transfer sheets P having various sizes within the maximum passage width W can be passed to be subjected to the fixing operation with the center lines thereof aligned with the center line C.

In FIG. 10A, the temperature detecting element 23 is disposed on the surface of the heater base 21 substantially on the center, that is, on the center line C. In this example, the temperature at the sheet passing portion can be detected irrespective of the size (width) of the transfer sheet P.

In the example of FIG. 10B, the temperature detecting element 23 extends along the entire length of the heater base 21 surface in the sheet passage region W, by which the average temperature in the region can be detected. In addition, there is no step despite the provision of the temperature detecting element.

In FIG. 10C, first and second temperature detecting elements 23 and 23a are disposed on the front surface side and the back surface side of the heater base 21 on the center line C. It is possible that the first temperature detecting element 23 on the front surface of the heater base 21 is used to control the temperature of the heater 20 by energization control to the heat generating element 22, and the second temperature detecting element 23a on the back side of the heater base 21 is used to prevent the overheating of the heater. The second temperature detecting element 23a is mounted on the heat generating element 22 through an insulating layer 21g.

Figure 11:
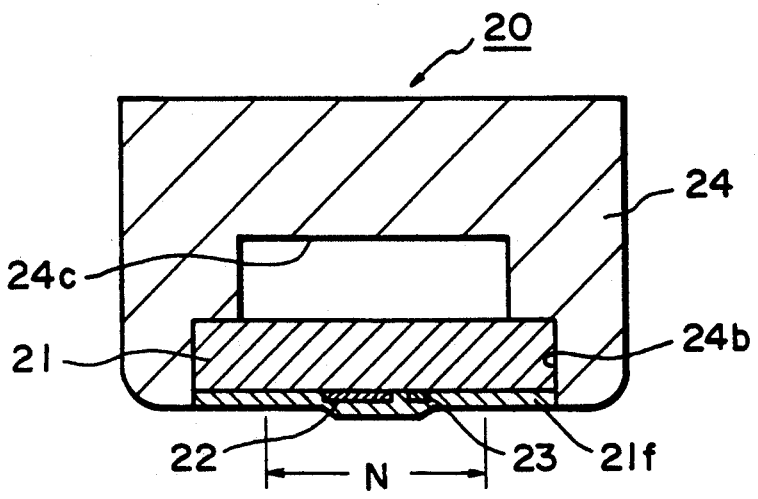
FIGS. 11 and 12 are sectional views of another examples of the heater.

As shown in FIG. 11, the heat generating element 22 of the heater base 21 may be disposed on the surface of the base plate 21. More particularly, the heat generating member 22 (heat generating resistor) and the temperature detecting element 23 are disposed within the range of the fixing nip N on the surface of the base 21. With this arrangement, the heat generating position is close to the fixing film and the toner, and therefore, the thermal efficiency is good. In this example, the material of the heat generating resistor 22 may be made of a material such as barium titanate having PTC property. In this case, when the temperature of the resistor increases by the electric energization nearly to the Curie temperature, the resistance thereof steeply increases with the result of reduced amount of heat generation, and therefore, the temperature is self-controlled at the level inherent to the resistor. Therefore, the necessity for the temperature detecting element 23 is eliminated.

Figure 12:
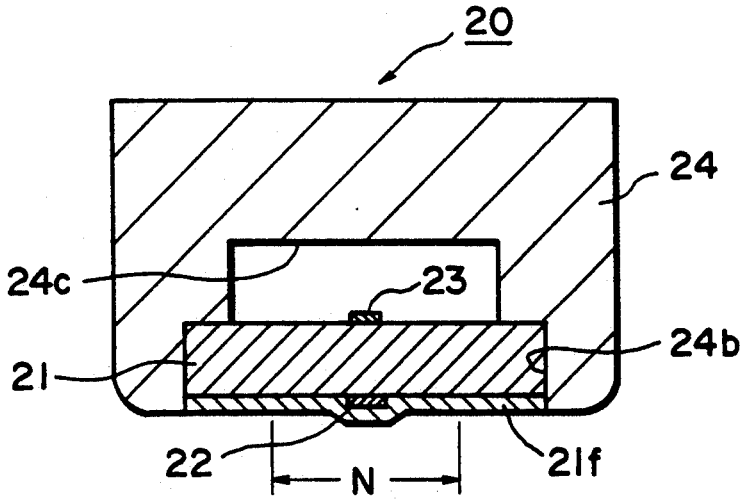
Figure 13:
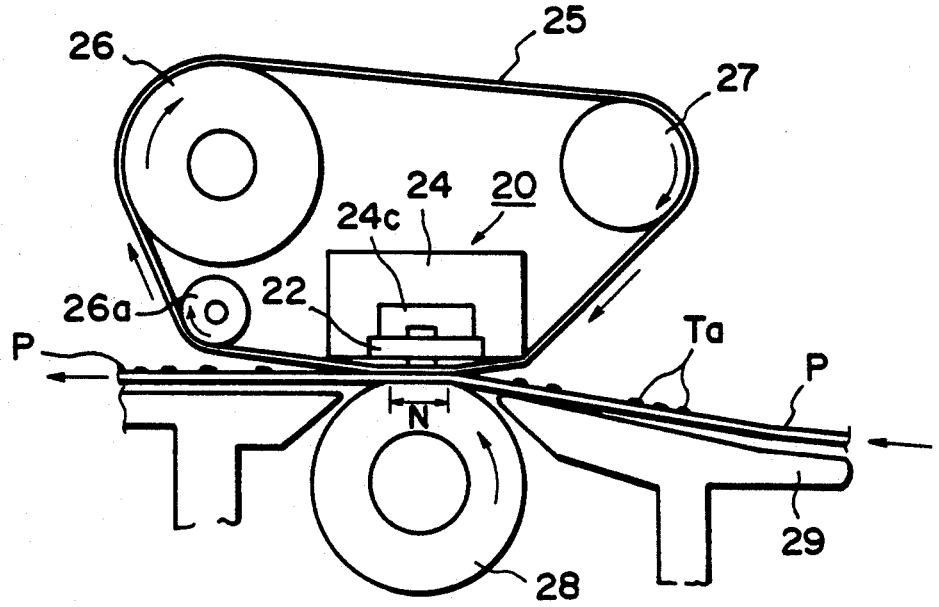
FIG. 13 is a sectional view of an fixing apparatus according to a further embodiment of the present invention.

As shown in FIG. 12, the heat generating element 22 may be mounted on the front surface of the base plate 21, and the temperature detecting element 23 may be mounted on the backside of the base plate 21 (opposite to the embodiment of FIG. 9). With this structure, the detected temperature can be different from the surface temperature of the heater base 21, and therefore, the relationship between the surface temperature of the heater base and the temperature of the back surface is determined beforehand, and the front surface temperature is predicted from the detected back surface temperature.

Where the cavity is provided between the heater base and the heater fixing member, the recording material (transfer material sheet) P may be separated from the fixing film 25 surface immediately after the heating step in the fixing nip N, as shown in FIG. 13. Similarly to the foregoing embodiments, the toner temperature at the separating position is higher than the glass transition point.

As will be understood from the foregoing, in the embodiments of the present invention, the low thermal capacity heater fixed is instantaneously raised in the temperature immediately after the electric energization.

The thermal capacity of the heater will be described.

Figure 14:
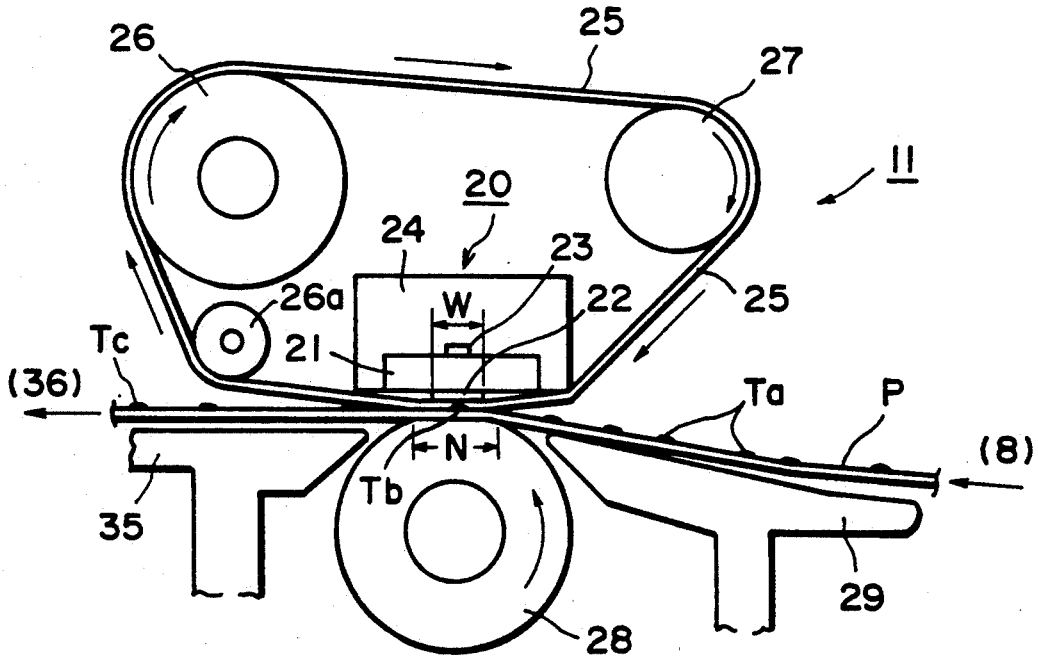
FIG. 14 is a sectional view of an image fixing apparatus according to a further embodiment of the present invention.

Referring to FIG. 14, the description will first be made as to a further embodiment. In this embodiment, the cavity 24c of FIG. 13 embodiments is not provided, and the embodiment of FIG. 14 is similar to the embodiment of FIG. 13 in the other respects, and therefore, the detailed description is omitted for simplicity. Reference characters Ta and Tb designates an unfixed toner and a high temperature fused toner, respectively. The temperature of the toner at the separating point is higher than the glass transition point.

While the sheet P separated from the fixing film 25 is being advanced to the couple of discharging rollers 36 along the guide 35, the temperature of the toner Tb having a temperature higher than the glass transition point is cooled spontaneously down to below the glass transition point, and therefore, it is solidified, and therefore, the sheet P on which the image has been fixed is discharged on the tray 12.

Figure 15A:
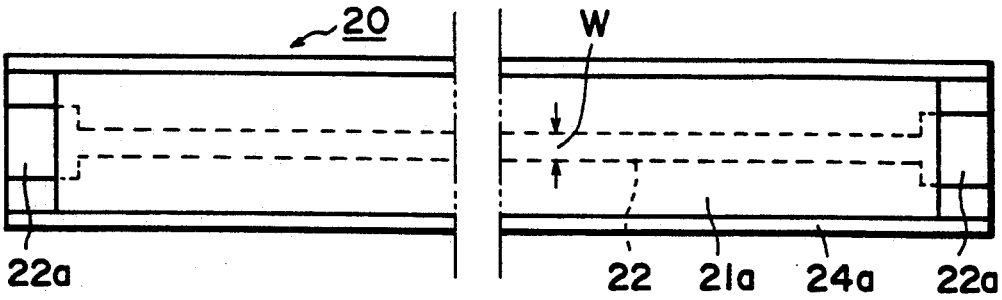
FIGS. 15A and 15B are a top plan view of the heater seen from a sliding surface side at an enlarged sectional view thereof.
Figure 15B:
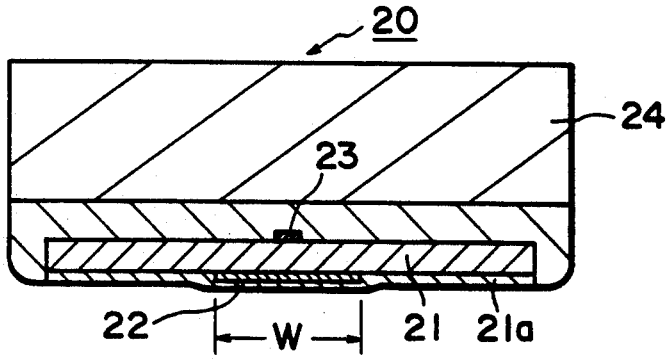

FIGS. 15A and 15B are a top plan view and an enlarged sectional view of the side of the heater 20 which is contactable with the fixing film. The heater has an alumina base plate 21 having a thickness of 0.64 mm, a width of 0.5 mm and a length of 250 mm and a heat generating resistor 22 applied thereon by screen sprinting. The heat generating resistor 22 has a width of 3 mm and a thickness of 20 microns. The heat generating resistor 22 is coated with a protection layer 21*a* having a thickness of 10 microns and made of a heat resistive glass. On the back side of the base plate 21, a temperature detecting element 23 such as a thermister is mounted. The base plate 21 having the heat generating element 22, the protection layer 21*a* and the temperature detecting element 23 is securedly fixed on a rigid supporting member (stay) 24 through an insulating plate 24*a* made of PI or the like. At the opposite ends of the heat generating element 22 is provided with power supply electrodes 22*a* and 22*a*.

The heater base plate 21 is made of alumina having a thermal conductivity of 25 J/m.S.K. Since it is a good thermal conductor, the temperature of the heat generating element is detected by the thermister 3 with quick response. By controlling the energy supply using the thermister 23, the temperature of the heat generating element 22 can be maintained at the fixable temperature during the fixing process. When a heat-fixing toner available from Canon Kabushiki Kaisha, Japan was used, the temperature of the heat generating element was maintained approximately at 180° C. on the average by the power supply of 150 W on the average, and the toner image was heat-fixed in good order.

The thermal capacity of the heat generating element 22 of this embodiment per unit length (1 mm) is $0.18\times10^{-3}$ J/Km (3 mm$\times$0.02 mm$\times$1 mm$\times3.0\times10^{-3}$ J/m$^3$.K) which is very small, and therefore, the temperature quickly increases upon energization by 300 W. The temperature reaches sufficiently fixable temperature within 5 sec which is the time required from the image formation state to the reaching of the transfer sheet P to the fixing device 11, when the heater is started to be preheated upon the image formation start. Thus, according to this embodiment, the fixing device does not require the waiting period with low power consumption.

In the conventional heating roller type fixing apparatus, the waiting period is longer even if the thermal capacity of the heat generating element is decreased, for the following reasons:

(1) Between the heat generating element and the heating roller, there is an air layer, and therefore, the heating roller is heated by the heat radiation from the heater, and therefore, the temperature of the heat generating element has to be increased far above the toner fusing point: and (2) The thermal capacity of the heating roller to be heated is large, so that the time is required for the heating.

In this embodiment, the heat is transferred from the heat generating element to the toner without the air layer and only through the protection layer 21*a* having a thickness of 10 microns and the fixing film 25 having the thickness of 40 microns, and therefore:

(a) The temperature of the heat generating element may be close to the toner fusing point: and (b) The portion to be heated is only the protection layer 21*a* and the fixing film 25 in the nip which have very small thermal capacities.

Because of the features (a) and (b), the thermal capacity of the heat generating element of this embodiment may be made very small, and therefore, the quick start and the low power consumption are accomplished.

Figure 16:
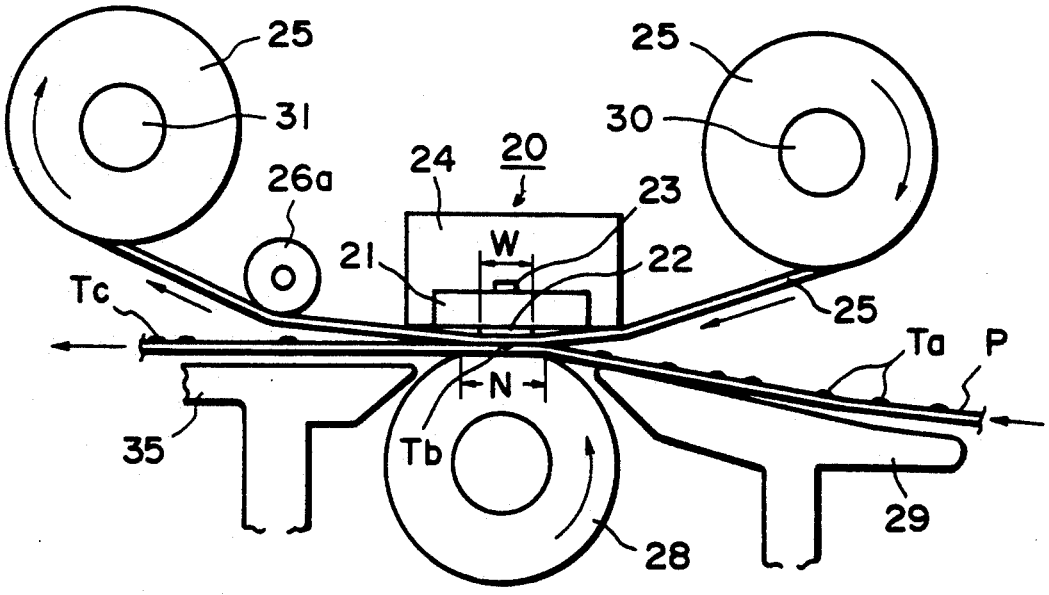
FIG. 16 is a sectional view of an image fixing apparatus according to a further embodiment of the present invention.

Also, in this embodiment, a non-endless film is used which is rewound after use and is repeatedly used, as shown in FIG. 16.

The inventor's experiments have revealed that for the accomplishment of the quick start and the low energy consumption, the thermal capacity per unit longitudinal length of the heat generating element is preferably not more than $2.05\times10^{-3}$ J/k mm.

In the foregoing embodiment, the base plate 21 is made of alumina having the good thermal conductivity in order to correctly detect the temperature of the heat generating element 22 on the base plate 21 by the temperature detecting element 23 mounted on the back side of the base plate 21. However, through the base plate 21 having the good thermal conductivity, a part of the heat generated by the heat generating element 22 is released, and therefore, the advantages of the use of the low thermal capacity heat generating element 22 is more or less deteriorated.

Figure 17A:
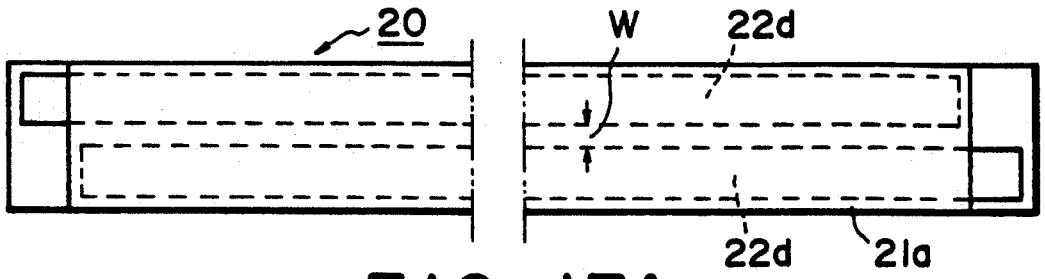
FIGS. 17A and 17B are a top plan view of a heater seen from a sliding surface side and an enlarged sectional view thereof, in another example.
Figure 17B:
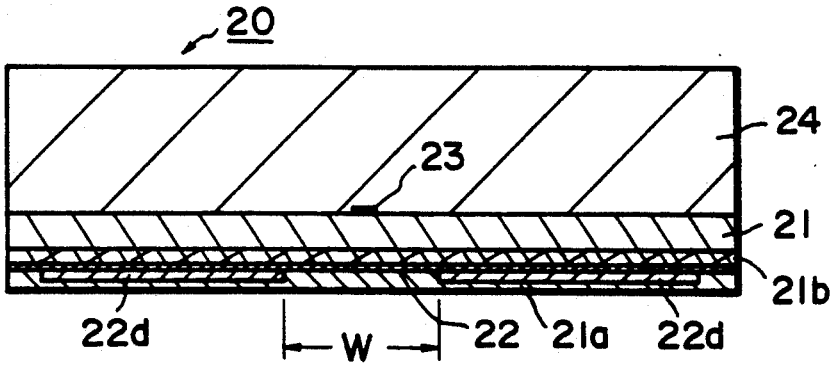

Referring to FIGS. 17A and 17B, a further embodiment of the present invention will be described. FIGS. 17A and 17B are top plan view and an enlarged sectional view of a fixing film sliding side of a heater 20. In this embodiment, in order to minimize the release of the heat generated by the heat generating element 22 through the base plate 21, thus increasing the temperature increasing speed of the heat generating element 22, the heat generating element (heat generating resistance layer) is mounted to the base plate (alumina base plate) 21 through an insulating layer 21*b* having a thickness of 500 microns. Designated by reference numerals 22*d* and 22*d* are electrodes made of gold extended on the surface of the heat generating element 22 along the length thereof with a space W therebetween. With the increase of the thickness of the insulating layer 21*b*, and with the decrease of the thermal conductivity thereof, the power consumption is decreased, and the temperature increasing speed is increased. However, the temperature detecting accuracy of the heat generating element by the temperature detecting element 23 is deteriorated. Therefore, the thickness and the material thereof are to be selected in consideration of the property of the toner used (for example, the temperature range from the high temperature off-set temperature and the low temperature off-set temperature).

For example, the heat-fixing toner available from Canon Kabushiki Kaisha, Japan has a wide range between the high temperature off-set temperature and the low temperature off-set temperature, and therefore, the fixing operation is possible without problem even if the base plate 24*a* is made only of glass having a thickness of 1 mm as in the heater 20 shown in FIGS. 8A and 8B. In this case, the fixable temperature was reached only in approximately 3 sec when the power supply is not more than 200 W.

In the example of FIGS. 19A and 19B, the heater 20 includes the base plate 24*a* made of PI resin (polyimide) which is a thermal insulator and a nichrome wire having a diameter of 0.1 mm is fixed on the insulative base plate 21. The thermal capacity per unit length of the heat generating element is $8.2\times10^{-5}$ J/Kmm (0.1 mm$\times$0.1 mm$\times2\times4.1\times10^{-3}$ J/Km). With this heater 20, the quick start is possible with low energy consumption. The temperature detecting element 23 is planted within the thickness of the base plate 24*a*. Designated by a reference 22*e* is a conductor in the form of a spring to accommodate the thermal expansion and contraction of the nichrome wire 22. The diameter of the nichrome wire 22 is larger adjacent the end portions which are not used for the image fixing to reduce the amount of the heat generation.

According to the inventor's experiments, when the resistor wire having a diameter of 0.5 mm that is, the heat generating element having the thermal capacity per unit length is approximately $2.0\times10^{-3}$ J/Kmm (0.5 m×0.5 m×2×$4.1\times10^{-3}$ J/Kmm$^3$) was used, the fixable temperature can be reached in approximately 7 sec when it is energized by 300 W power, and therefore the quick start is possible.

The description has been made as to the thermal capacity of the heat generating element 22, the thermal capacity of the heater will be described in terms of the quick start and the reduction of the energy consumption. Here, the heater means the portion which is integrally formed with the heat generating element and is increased in the temperature to a level substantially equal to that of the heat generating element upon energization. The heater contains the heat generating element and the portion of the heat generating element side from the insulating layer. The heat insulating layer is effective to transfer the heat of the heater, and is defined as a layer having a thickness of not less than 100 microns made of a material having a thermal conductivity of not more than 5 J/m.S.K.

As to the structure of the fixing apparatus in this description, the one shown in FIG. 14 is taken. The description will then be made as to the heater 20. The heater 20 has the structure shown in FIG. 15. The heater 20 includes an alumina base plate 21 having a thickness of 1.0 mm, a width of 16.0 mm and a length of 250 mm and a heat generating resistance element made of silver-palladium (heat generating element 22) applied on the base plate 21 by screen printing in a width of 2 mm and a thickness of 20 microns. On the heat generating element 22, a protection layer **21*a* made of heat-resistive glass and having a thickness of 10 microns is applied. They are integrally formed. On the back side of the base plate 21, a temperature detecting element 23 such as a thermister is mounted. The base plate 21 having the heat generating element 22, the protection layer 21*a* and the temperature detecting element 23*a* is securedly mounted on a rigid supporting member 24 through an insulating plate 24*a* made of PI (polyimide) or the like. The heat generating element 22 is provided with power supply electrodes 22*a* and 22*a*** at its opposite ends.

During the fixing operation, the temperature of the heater is detected by the thermister 23 functioning as the temperature detecting element, and in response to the detected temperature, the heat generating element 22 is energized by the power supply through the electrodes **22*a* and 22*a* to maintain the temperature of the heater at the optimum fixing temperature. When a heat-fixing toner available from Canon Kabushiki Kaisha, Japan was used, and the temperature of the heater was maintained at 180° C., the heat is sufficiently transferred to the toner image through the fixing film 25** having a total thickness of 35 microns in the fixing nip N portion, so that the image was heat-fixed in good order.

The insulating layer **24*a* is made of resin such as PI having the thermal conductivity of 0.2 J/m.S.K and having a thickness of 3 mm. It serves to prevent the release of the heat from the heater to the supporting member 24. In the heater 20 of this embodiment, the thermal capacity of the heater to be heated by the heat generated by the heat generating element, per unit length, is approximately $7.1\times10^{-2}$ J/Kmm (alumina base plate 21=1 mm×16 mm×1 mm×$4.4\times10^{-3}$ J/K.mm$^3$ heat generating resistor 22=0.02 mm×2 mm×1 mm×$4.5\times10^{-3}$ J/K mm$^3$: and protection layer 21*a***=0.01 mm×16 mm×1 mm×$2.0\times10^{-3}$ J/K.mm$^3$), which is very small. Therefore, the temperature is quickly heated up to 180° C. with low electric power. Therefore, the quick start with low energy consumption is accomplished.

The inventor's experiments with the fixing device having the structure described above incorporated in an image forming apparatus, have revealed that upon the start of the energization of the fixing apparatus with 300 W electric power, the temperature of the heater has increased up to 180° C. within 5 sec. The image forming apparatus used requires more than 5 sec from the start of the transfer material sheet feed to the introduction into the fixing device 11, and therefore, the image forming operation can be started without starting the preheating from the actuation of the start switch.

In a conventional heat roller type fixing device, the heat generating heater and the heating roller have large thermal capacities, and therefore, it is difficult to reach the fixable temperature within 10 min, so that the user of the image forming apparatus has to wait until the fixable temperature is reached.

In the heater 20 of this embodiment, the PI insulating plate is used for the insulating layer **24*a*. However, by employing the shape of the heat insulating layer 24*a* made of PI, as shown in FIG. 20, that is, the contact surface with the base plate 21 is corrugated to provide an air layer 24*b* in the interface with the base plate 21 to use the heat insulating effect of the air is utilized. By doing so, the temperature increasing speed is further improved. With this structure, even when the heater having the alumina base plate 21** having a width of 16 mm and a thickness of 3 mm (the thermal capacity per 1 mm length is $2.18\times10^{-1}$ J/K.mm, and the length is 230 mm, and the total weight is 43 g) is used, the quick start image forming apparatus has been achieved.

However, preferably, the thermal capacity of the heater is smaller. For example, a heat generating resistor 22 is screen-printed on an alumina base plate 21 having a width of 5 mm and a thickness of 1 mm.

In this embodiment, the surface of the heat generating resistor 22 is coated with a protection layer **21*a* made of heat resistive glass. However, when the portion of the fixing film 25 contacted to the heater 20** is made of non-electric-conductive material, the protection layer may be omitted.

Figure 22:
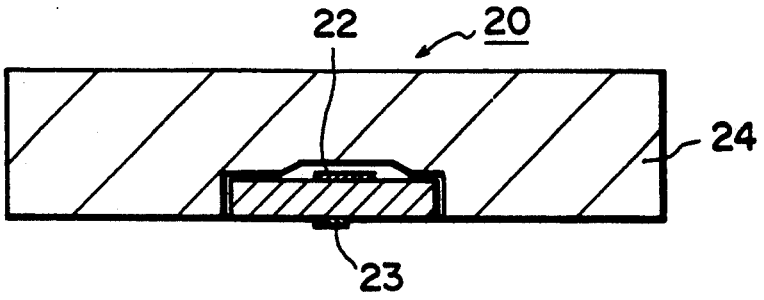

As shown in FIG. 22, the heat generating resistor layer 22 is sandwiched between alumina plates 21 and **21*b*** having good thermal conductivity. Even when this structure is employed, the quick start is possible when the thermal capacity per unit length of the heater is not more than $2.2\times10^{-1}$ J/K.mm$^3$.

As shown in FIG. 22, the heat generating element 22 is formed on a side of the heater base plate 21 which is opposite from its side contacting to the fixing film, and a temperature detecting element 23 is formed on the side contacting to the fixing film. By doing so, the temperature can be detected in the heater and adjacent to the fixing film, and therefore, the temperature control is better.

Figure 23:
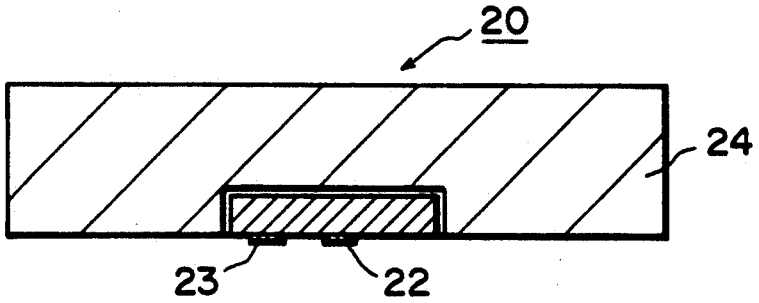

As shown in FIG. 23, both of the heat generating element 22 and the temperature detecting element 23 are formed on the front side of the base plate 21 (the side contacting to the fixing film).

Figure 24A:
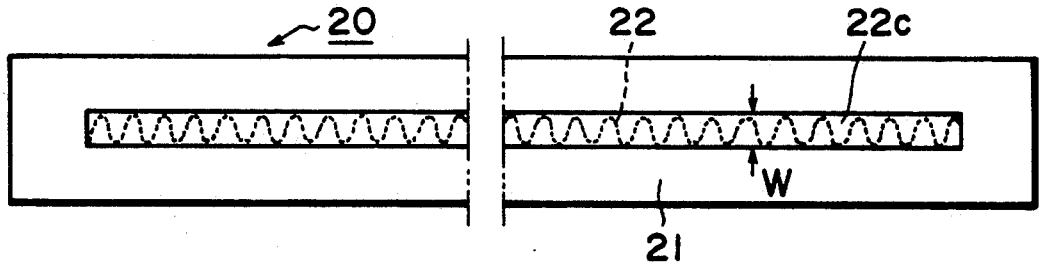
FIGS. 24A, 24B, 25A, 25B and 25C are an enlarged sectional view or a top plan view of a heater illustrating examples of positions of the temperature detecting elements.
Figure 24B:
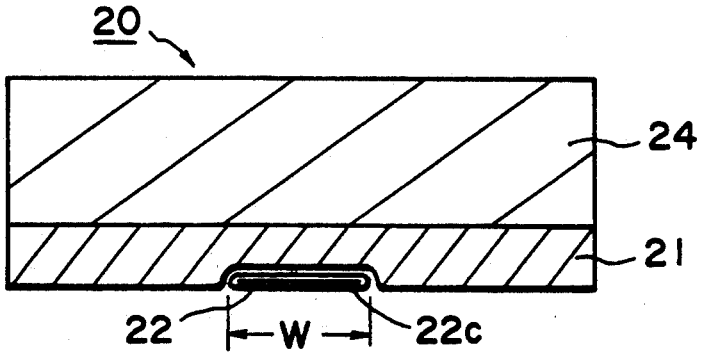

As shown in FIGS. 24A and 24B, the heat generating element 22 may be made of a resistor wire made of nichrome or the like, and it is enclosed with an alumina plate 22*c* in order to provide a larger heating width W. FIG. 24A is a plan view of the side of the heater 20 contacting to the fixing film, and FIG. 24B is an enlarged sectional view.

Figure 18A:
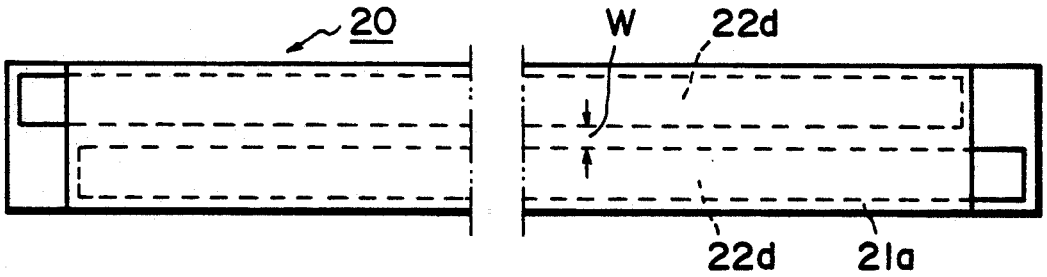
FIGS. 18A and 18B are a top plan view of a heater seen from a sliding surface side and an enlarged sectional view thereof, in a further example.
Figure 18B:
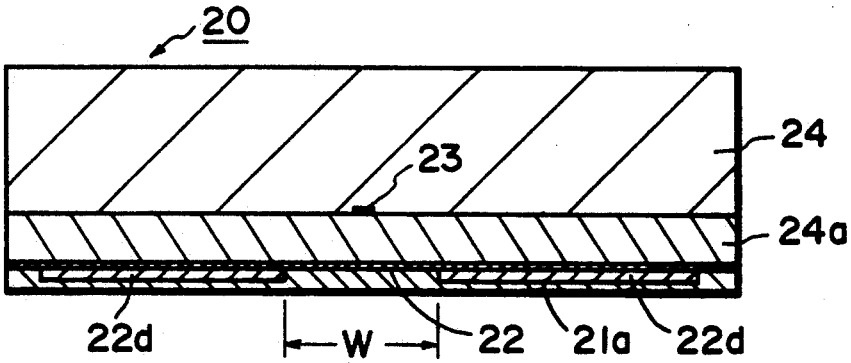

A yet further embodiment will be described. Since the structure of the heater is similar to that shown in FIG. 18, and therefore, the drawing is omitted for simplicity. In this embodiment, the heater includes an insulating layer 24*a* having a thickness of 0.5 mm and a width of 16 mm and made of heat-resistive glass, a heat generating element 22 (heat generating resistance layer) having a thickness of 5 microns and made of $TaSiO_2$ and formed by sputtering on the surface of the insulating layer, a pair of electrodes 22*d* and 22*d* having a thickness of 2 microns made of gold extended parallel along the length of the heat generating element 22 with a space W therebetween formed on the resistance layer surface for power supply, and a protection layer 21*a* thereon. Having a thickness of 5 microns and made of $Ta_2O_3$. With this structure, the heat generating resistance layer 22 is formed on the insulating layer 24*a*, and therefore, the heater is constituted by the heat generating resistance layer 22, the gold electrodes 22*a* and 22*d* and the protection layer 21*a*. The thermal capacity per unit length is approximately $8.7\times10^{-4}$ J/K.mm (heat resistance layer 22=0.005 mm×16 mm×1 mm×$4.5\times10^{-3}$ J/K.mm$^3$ gold electrodes 22*a*=0.002 mm×7 mm×1 mm×$2\times2.5\times10^{-3}$ J/K.mm$^3$ and protection layer 23*a*=0.005 mm×16 mm×1×$4.4\times10^{-3}$ J/k.mm$^3$) which is very small. Therefore, upon energization, the temperature of the heater is increased quickly with further lower power consumption. The experiments using the same toner as in the previous embodiment has revealed that the temperature of the heater has reached to the fixable temperature within 3 sec when 200 W power supply is carried out, in this embodiment.

In this embodiment, the heater has 1/100 thermal capacity as compared with the foregoing embodiment. However, the power consumption is not 1/100. The reasons are that most of the heat generated is used for fixing the unfixed toner image, and that the glass used in the insulating layer 24*a* has a slightly worse heat insulating property as compared with the PPS resin.

However, in this embodiment, the slightly worse heat insulating property of the glass is utilized by predicting the temperature of the heater on the basis of the temperature detected by the thermister 23 (temperature detecting element) contacted to the back side of the insulator 24*a*, and the electric power is supplied to the heat generating element so as to maintain the temperature of the heater at the fixable temperature level.

In this embodiment, when the temperature of the heater is 180° C., the temperature of the backside of the heat insulator 24*a* is approximately 100° C. The temperature difference ΔT between the heater and the backside of the heat insulator is decreased by approximately 5° C. by each of one minute continuous energizations. A table representing a relation among the temperature of the heater, the temperature of the backside of the insulator and the energization time is stored in a ROM, and the energization of the heater to maintain it at the fixing temperature is controlled using a microcomputer containing the ROM.

Figure 25A:
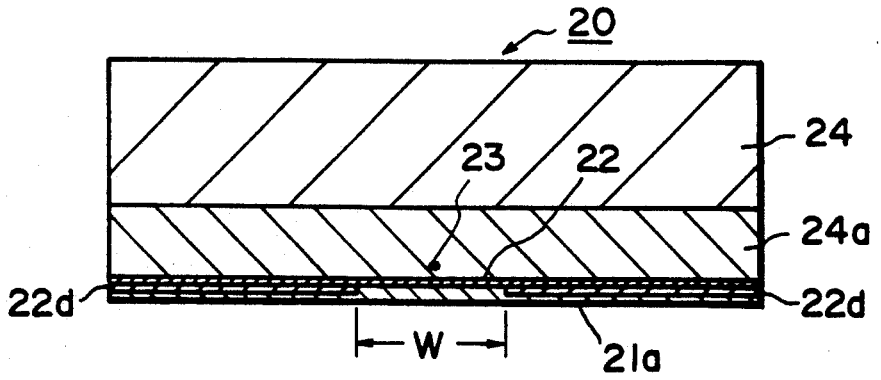
Figure 25B:
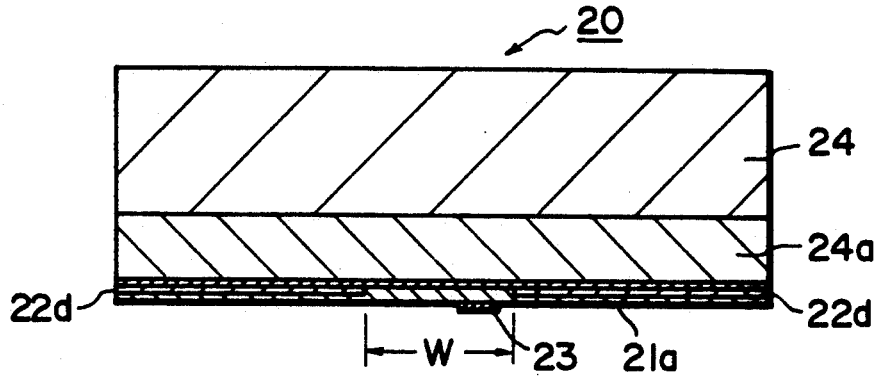
Figure 25C:
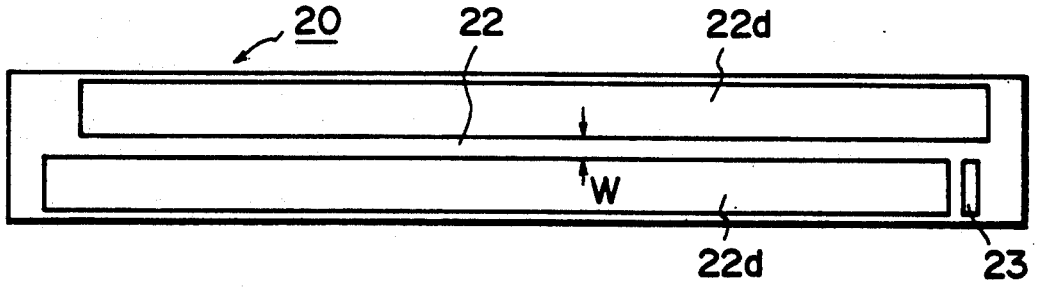

Depending on the individual toners, the temperature has to be accurately detected, and the temperature of the heater is accurately controlled. If this is the case, the temperature may be detected by the accurate temperature detecting means shown in FIGS. 25A, 25B and 25C. In FIG. 25A, the temperature detecting element 23 is planted within the thickness of the insulator 24*a*, by which it is made closer to the heat generating element. In FIG. 25B, the element 23 is mounted on the protection layer 21*a* at a position where the heat is not passed. In FIG. 25C, a material exhibiting different resistance depending on the temperature (PTC property) is evaporated at the end portions, similarly to the gold electrodes, wherein the change in the resistance is detected.

In this embodiment, the heat generating element is directly formed on the heat insulating layer 24*a*, by which the heat generating element is made very small. As shown in FIGS. 19A and 19B, the structure may be such that the heat generating element is the entirety of the heater. That is, the heat generating element 22 of a nichrome wire is fixedly supported at the longitudinal opposites ends on a heater supporting member comprising a heater stay 24 made of metal and a heat insulating plate 24*a* made of PI resin bonded thereon. An electric conductor 22*e* in the form of a spring functions to accommodate the thermal expansion and contraction of the nichrome wire 22 due to the temperature change. The size of the nichrome wire is larger at the marginal portions where the fixing operation is not performed is large to increase the resistance there, thus decreasing the amount of heat generation.

Referring to FIGS. 26A-26D, other embodiments of the heater will be described.

Figure 26A:
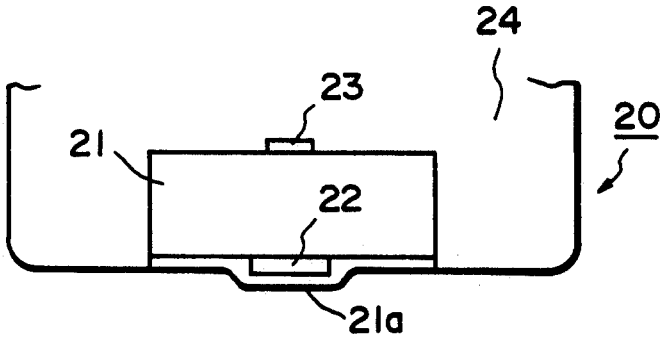
FIGS. 26A, 26B, 26C and 26D and 27 are enlarged sectional views illustrating heaters of further examples.
Figure 26B:
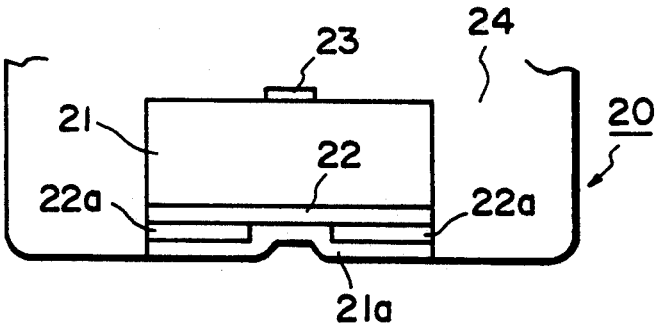
Figure 26C:
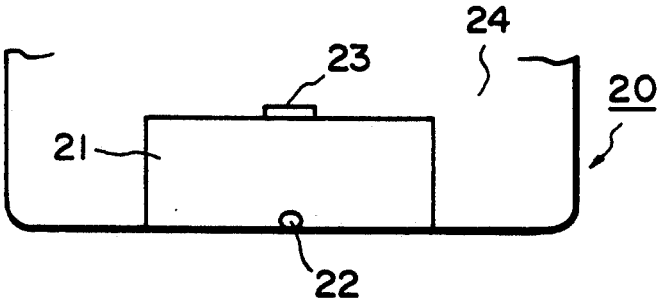
Figure 26D:
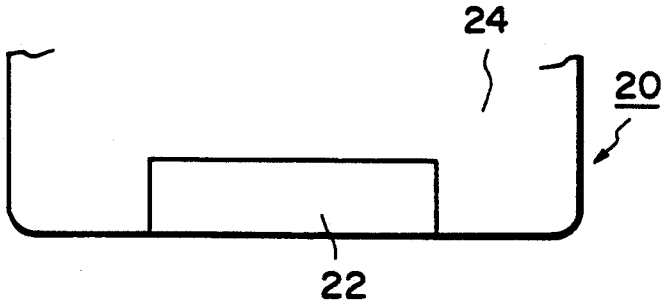

In FIG. 26A, as a heat generating element 22, Ag/Pd (silver-palladium) resistance layer having a thickness of 10 microns and a width of 1-3 mm is printed on an alumina base plate 21 surface, and as a surface protection layer, heat resistive glass 21*a* having a thickness of not more than 10 microns is applied. They are mounted on a rigid supporting member (heater supporting member) 24 having a low thermal conductivity (insulating material).

In FIG. 25B, as the heat generating element 22, a heat generating resistance layer of $TaSiO_2$ having a thickness of 0.1 micron is evaporated on a glass base plate 21 surface, and electric power supply electrodes 22*a* are pattern-evaporated, and in addition, as a surface protection layer 21*a*, $Ta_2O_5$ is evaporated in the thickness of approximately 5 microns, and they are mounted on a supporting member 24.

In FIG. 25C, as the heat generating element 22, a nickel-chrome heat generating wire is stretched on an alumina or heat-resistive glass base plate 21, or at last a part of the wire is embedded. They are mounted on the supporting member 24.

In FIG. 25D, the heat generating element 22 is made of a heat generating member block made of ceramic material or the like, and it is mounted on the supporting member 24, as it is.

The heating portion of the heater 20, that is, the portion mainly composed of the heater base plate 21, the heat generating element 22 and the temperature detecting element 23 has preferably a low thermal capacity from the standpoint of the efficiency of the energy consumption. However, the mechanical strength may be insufficient in view of the pressing force provided by the pressing roller 28. If this is the case, a supporting member 24 is mounted to the heating portion as the reinforcing member to assure the entire mechanical strength of the heater 20.

The supporting member can provide the following advantages in addition to the reinforcing effect:

(1) By making the supporting member 24 from PPS, Bakelite or ceramic which have low thermal conductivity, it can function as the heat insulator description in conjunction with the foregoing embodiment, by which the heat supply to the fixing film is enhanced, and the heat dissipation to other than the heating portion, and the resultant temperature rise, can be prevented.

(2) When the positional accuracy between the fixing nip N and the heat generating element is required, the center of the pressing member and the center of the heat generating element are required to be accurately aligned. It may be difficult to align them when the thermal capacity of the heater is small. If this is the case, the supporting member 24 may be provided with a dimensional reference (for example, a pin) which is effective to increase the positional accuracy.

Figure 27:
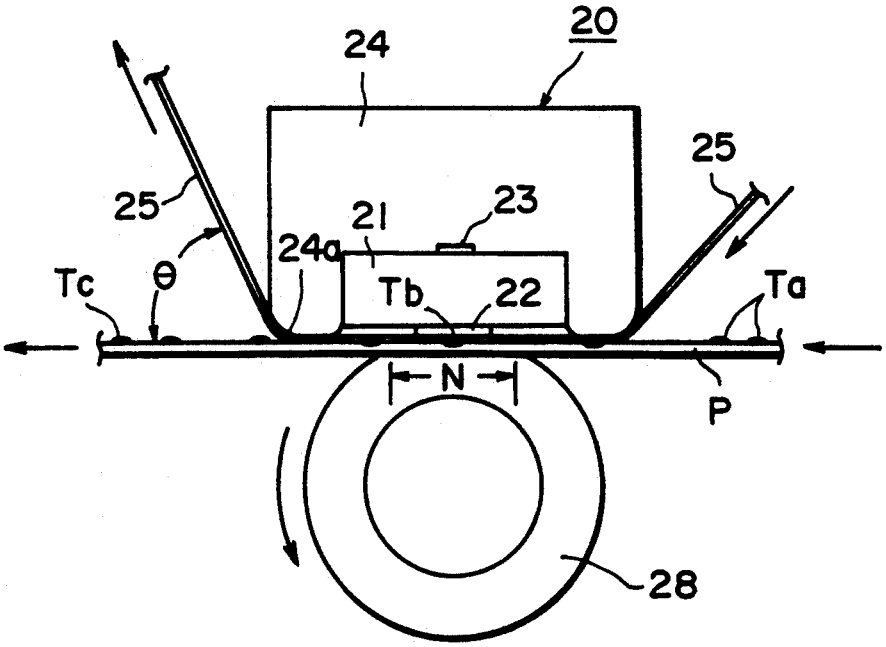

(3) As shown in FIG. 27, the supporting member 24 may also function as a guiding member for the fixing film. As compared with the heater base plate 21, the corner 24*a* can be easily rounded with a smooth surface. When it is used as the guiding member for the sliding movement of the fixing film, the wearing of the fixing film can be prevented or reduced.

On the deflection angle $\theta$ ($0<\theta<180°$) of the sheet P from the fixing film 25 surface after the fixing can be arbitrarily selected. In the inventor's experiments wherein a solid black toner image is formed at the leading edge of a thin sheet (46 g/m$^2$) having a direction of the paper fibers perpendicular to the sheet conveying direction, and the thin paper is subjected to the fixing operation, the sheet P has been prevented from sticking to the fixing film 25 when the deflection angle is not less than 30 degrees. That is, the separating pawl was not required. The tendency for the upward curling which the conventional heating roller has depending on the radius of curvature thereof, has been prevented by making the heating portion (fixing nip N) is made flat and by increasing the separating angle $\theta$ of the fixing film 25.

Figure 28:
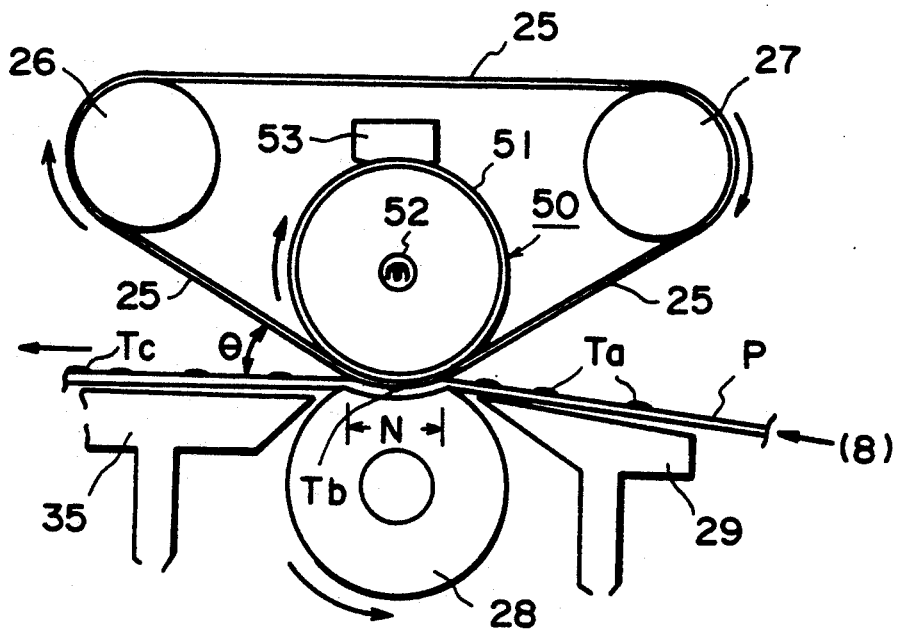
FIG. 28 is a sectional view of an image fixing apparatus according to a further embodiment of the present invention.

Referring to FIG. 28, a further embodiment will be described. In this embodiment, an endless fixing film 25 is stretched around a left driving roller 26, a right follower roller 27 and a heater 20 fixed between the rollers 26 and 27 at a lower position, the rollers 26 and 27 and the heater 20 being extended parallel.

The follower roller 27 functions as a tension roller for the endless belt. When the driving roller 26 rotates in the clockwise direction, the fixing film 25 rotates in the clockwise direction at a predetermined peripheral speed, that is, the speed same as the transfer sheet P supplied from the image forming station 8 and having thereon an unfixed toner image Ta, without crease, snaking movement and delay.

The heater 50 in this embodiment comprises a rotatable aluminum pipe 51 having a thickness of 1.0 mm, and outer diameter of 25 mm and a length of 240 mm, and a halogen heater 52 (heat generating element) disposed at the center of the aluminum tube. The heater is in this embodiment, therefore, a heating roller. To the surface of the heating roller 50 of the heater, a temperature detecting element 53 such as a thermister contacted. The power supply to the halogen heater 52 is controlled such that the temperature detected by the element 53 is maintained at a predetermined level.

A pressing roller 28 has a rubber elastic layer made of LTV containing silicone oil or silicone rubber having good releasing property. It is pressed to the heater 50 through the bottom travel of the endless fixing film 25 by an unshown urging means with a total pressure of 4–7 kg/A4 width. It is rotated in the counterclockwise direction to move in the same peripheral direction as the transfer sheet P.

The endless fixing film 25 is made of, for example, polyimide, polyether imide, polyparabonic acid, polyphenyl sulfide (heat resistive resin) and has a thickness of 20 microns and an outside diameter of 70 mm. The outer surface thereof is coated with a parting layer having a thickness of 5 microns made of fluorine resin such as PTFE (polytetrafluoroethylene) or PFA (perfluoroalkoxy resin) added with conductive material such as graphite. It is a heat-resistive thin film having a total thickness of 25 microns. The fixing film 25 has a thickness smaller than 40 microns, and the thermal capacity per 1 cm$^2$ thereof is less than $1.5\times10^{-2}$ J/K.

In response to an image formation signal, an image forming operation is performed, and a transfer sheet P carrying on its top surface and unfixed toner image Ta is introduced into the fixing device 11 from the transfer station 8. More particularly, it is guided along the guide 29 and is introduced into the nip N (fixing nip) formed between the heater 20 and the pressing roller 28, more particularly into between the fixing sheet 25 and the pressing roller 28. The toner image is passed through the fixing nip N together with the fixing film 24 moving at the same speed as the sheet P, while being in close contact with the bottom surface of the fixing film 25, without surface deviation or production of crease.

During the passage through the fixing nip N, the toner image supporting surface of the sheet P receives the heat through the fixing film 25 from the heat generating element 22, and the toner image is fused at the high temperature and is fuse-bonded on the sheet P as the fused toner Tb.

The fixing film 25 has a thin total thickness (25 microns), and the thermal capacity per 1 cm$^2$ is low (lower than $1.5\times10^{-2}$ J/K), and therefore, the heat from the heater 20 is efficiently transferred to the sheet P in the fixing nip N. As a result, the waiting period of the fixing apparatus can be reduced, and the power consumption can be saved, as described in paragraph (a) in the foregoing.

Figure 29:
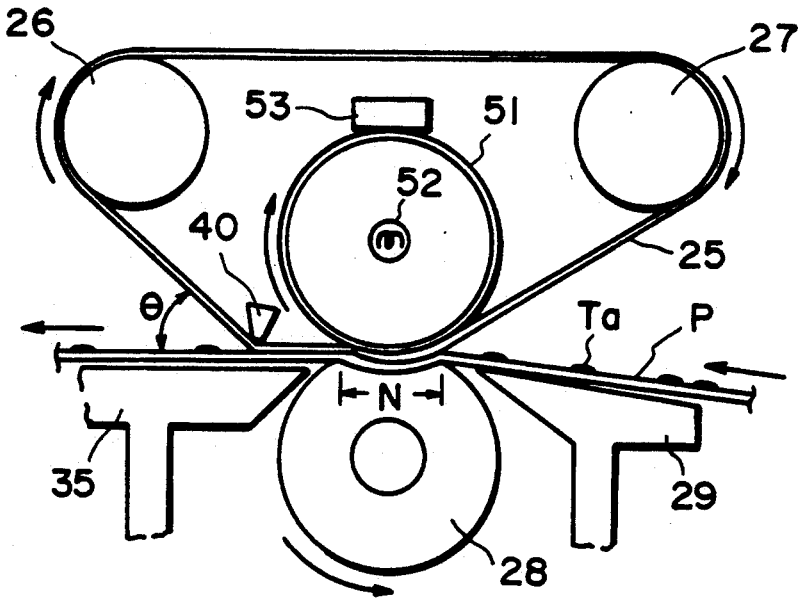
FIGS. 29–31 are sectional views of the image fixing apparatuses according to further embodiments of the present invention.

As shown in FIG. 29, in this embodiment, the sheet P and the fixing film 25 are separated at a point after the fixing nip N. At the point of time of the separation, the temperature of the toner Tb is still higher than the glass transition point of the toner. In this embodiment, a film guide 40 is press-contacted to the backside of the film at a position adjacent to the outlet side of the fixing nip N in the portion of the bottom travel of the fixing film 25 between the heater 50 and the fixing film driving roller 26. By the film guide 40, the fixing film having passed through the fixing nip is deflected toward the driving roller 26 at a large deflection angle $\theta$, so that the film 25 is sharply deflected away from the sheet P surface. By doing so, the separation between the sheet P and the fixing film 25 is further assured. Since the thickness of the film 25 is small, the deflection angle $\theta$ of the film guide 40 can be made large, and therefore, the sheet P is prevented from sticking to the surface of the fixing film 25.

In FIG. 29 embodiment, as compared with FIG. 28 embodiment, the temperature of the toner at the separating point is lower. Therefore, the toner can be heated up to a higher temperature, and in addition, the coagulation force of the toner at the separation can be increased. Still, the temperature of the toner at the separating position is higher than the glass transition point in FIG. 29 embodiment.

Figure 30:
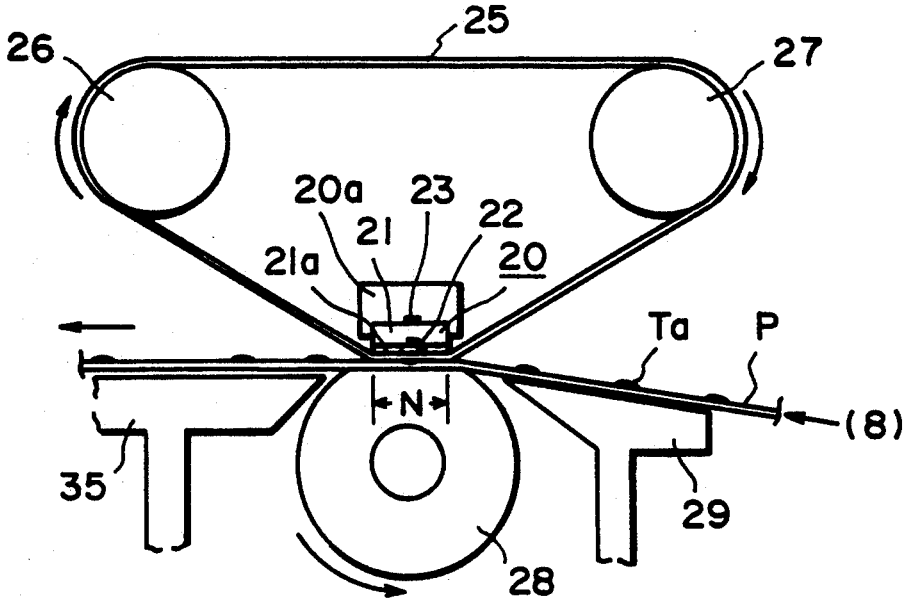
Figure 31:
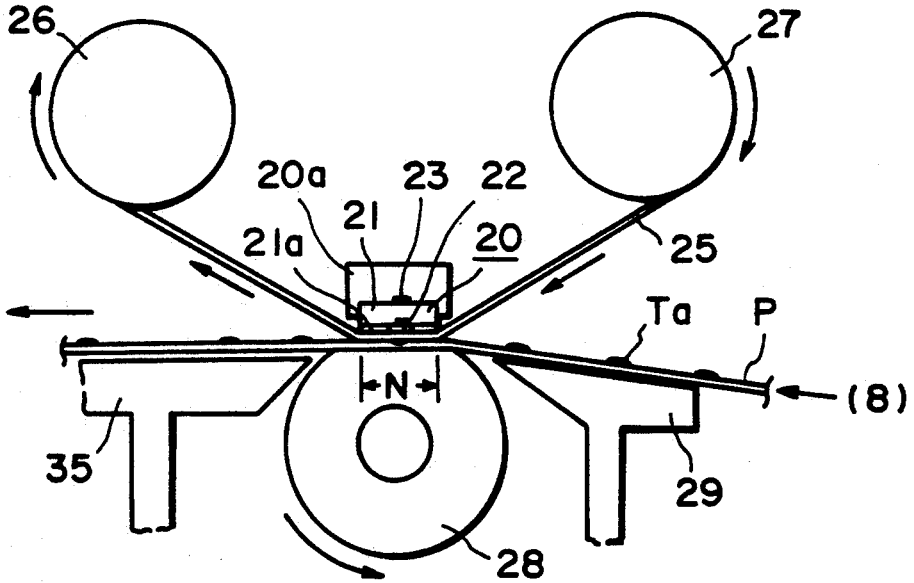

In FIGS. 30 and 31, the heater 20 is a fixed low thermal capacity linear heater. In this embodiment, the heater 20 is extended in the lateral direction of the fixing film (in a direction perpendicular to the travel direction of the fixing film 25). It includes an alumina base plate 21 having a thickness of 1 mm, a width of 10 mm and a length of 240 mm, a linear heat generating resistance layer 22 on the surface thereof (the surface contacting to the fixing film 25), the resistance layer 22 being made of Ag/Pd or the like, and a protection layer 21*a* thereon having a thickness of approximately 10 microns. The protection layer is made of heat resistive glass and has a smooth surface. To the backside of the heater 21, a temperature detecting element 23 such as a thermister is mounted. On the basis of the temperature detected by the temperature detecting element 23, the power supply to the linear heat generating resistance layer 22 is controlled.

The heater 20 is supported on a heat insulative rigid supporting member 20*a* made of heat resistive resin such as polyphenylene sulfide, polyamide imide, or polyimide. They are fixed on the fixing device by an unshown metal supporting table.

Figure 32:
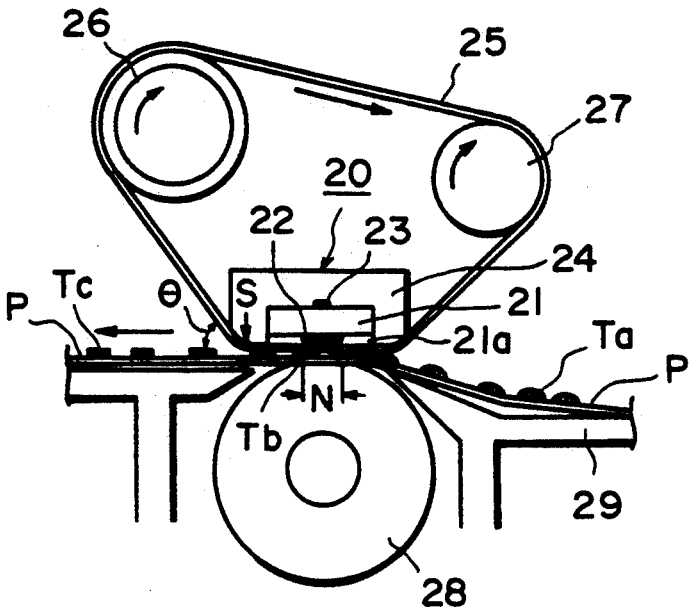
FIG. 32 is a sectional view of an image fixing apparatus according to a further embodiment of the present invention.
Figure 33:
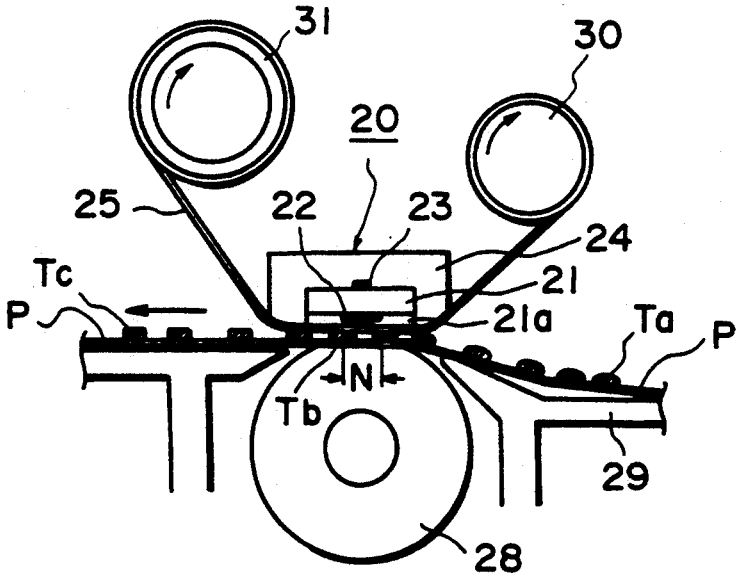
FIGS. 33 and 40 are sectional views of image fixing apparatuses according to further embodiments of the present invention.

FIGS. 32 and 33 show further embodiments. Those embodiments are self-explanatory for one skilled in the art by referring to those Figures without particular description, when the foregoing descriptions are considered. Therefore, the detailed descriptions are omitted for simplicity.

The description will be made further as to the fixing film 25 used in this embodiment.

Figure 34:
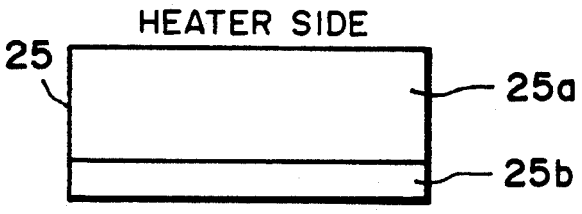
FIGS. 34–38 are sectional views of a fixing film used in the image fixing apparatuses according to the present invention.

FIG. 34 shows the section of the laminated structure of the fixing film 25. A heat resistive layer 25*a* is a base layer (base film) of the fixing film 25, and it has a good mechanical strength. The bottom surface of this layer is contacted to the heater 20. A releasing layer 25*b* is laminated on the outer surface of the heat resistive layer (the surface contactable to the toner image).

The heat resistive layer 25*a* has a thickness of 18 microns and is made of polyimide. The other usable materials are highly heat resistive resin such as polyether ether ketone (PEEK), polyether sulfone (PES), polyether imide (PEI), polyparabonic acid (PPA), or metal such as Ni, SUS, Al (which are good in the mechanical strength and the heat resistivity). The heat resistive layer 25*a* is a seamless cylinder provided by casting method using a cylindrical mold in this embodiment using polyimide. The method of providing the seamless cylinder is not limited to this. For example, a polyimide film sheet is bonded to provide the cylindrical form, and then the bonded portion is abraded. In the case of the thermoplastic resin such as PES, the seamless cylinder can be provided by implantation method. When metal such as Ni is used, the seamless cylinder can be provided by an electroforming method.

The releasing layer 25*b* is made of polytetrafluoroethylene (PTFE) having a thickness of 7 microns. Other usable materials are fluorine resin such as PFA or FEP or silicone resin such as RTV silicone rubber having good releasing property relative to the toner.

The method of the laminated releasing layer 25*b* on the heat resistive layer 24*a* will be described. Dispersion liquid containing PTFE particles is applied uniformly on the heat-resistive layer 25*a* by a spray method, and is dried and sintered. During the sintering, the releasing layer 25*b* made of PTFE is thermally contracted, and therefore, there is a liability that the fixing film 25 is deformed. In order to avoid this problem, the thickness of the heat-resistive layer 25*a* is larger than the thickness of the releasing layer 25*b*. The method of formation of the releasing layer 25*b* is not limited to the above-described. For example, the dispersion liquid containing the PTFE resin particles may be applied by a dipping method, a roll coating method or an electrostatic painting method. In place of using the dispersion liquid containing the PTFE particles, the releasing layer 24*b* may be formed by a CVD method or a vacuum evaporation method. Alternatively, a releasing layer film may be laminate-bonded on the surface of the heat-resistive layer 25*a*. In that case, the releasing layer 25*b* in the form of a seamless cylinder may be covered on the outer surface of the heat-resistive layer 25*a* in the form of seamless cylinder, and is heat-bonded. Further alternatively, the outer surface of the heat-resistive layer 25*a* in the form of a seamless cylinder is covered with the releasing layer 25*b* in the form of a sheet, and is heat-bonded. In the latter case, the connecting seam of the releasing layer 25 may be made substantially in the seamless form by using a thermoplastic material having low viscosity when fused. Further alternatively, a heat-resistive layer 25*a* sheet and a releasing layer 25*b* sheet are first laminate-bonded, and thereafter, they are bonded into a cylinder, and thereafter, the connecting portion is treated for the seamless cylinder.

The thickness of the fixing film 25 in this embodiment is preferably thin so as not to impede the heat transfer from the heater, and is preferably not more than 100 microns, and further preferably not more than 40 microns. However, if it is too thin, it becomes difficult to drive the fixing film without production of crease, and therefore, the thickness of the heat-resistive layer is not less than 6 microns, further preferably not less than 12.5 microns.

In the fixing film 25 of this embodiment, the so-called pencel hardness of the releasing layer (JIS K5400) (500 g)) is 4b–9h, the preferably Hb–9h at normal temperature. At 200° C., it is preferably 5b–9h, and further preferably 2b–9h. In order to provide sufficient bonding strength to meet the above pencil hardness, the surface of the heat resistive layer is treated for rough surface by agent such as or corona discharging. Examples and Comparison Examples of the fixing film will be described.

COMPARISON EXAMPLE 1A

The fixing film made only of polyimide was used. The surface energy of the polyimide is large, and therefore, a small amount of toner was off-set to the fixing film. Since the recording material and the film were separated when the temperature of the toner is higher than the glass transition point, particularly higher than the softening point, and therefore, the amount of toner off-set was large when the film was made only of the polyimide resin.

COMPARISON EXAMPLE 1B

The fixing film was made only of fluorine resin such as PFA or PTFE. The fixing film was thermally contracted by the heating from the heater. Since the fixing film was sliding on the heater while the temperature thereof was high, the wearing of the sheet was significant with the result of insufficient durability.

EXAMPLE 1B

When the fixing film 25 is of plural layers, they can be separated if the bonding strength therebetween is not sufficient. In consideration of this, in FIG. 35 embodiment, a bonding layer 25*c* made of fluorine resin is provided between the heat resistive layer 25*a* and the releasing layer 25*b*.

In the example wherein the heat-resistive layer 25*a* had a thickness of 18 microns and was made of polyimide, and the releasing layer 25*b* had a thickness of 7 microns and was made of PTFE, the pencil hardness was HB. When the bonding layer 25*c* containing the fluorine resin having a thickness not less than 1 micron, preferably not less than 3 microns, the pencil hardness is improved up to 3H.

Alternatively, the material of the releasing layer 25*b* is a film in the form of a sheet or a seamless tube made of fluorine resin such as PFA, and the bonding layer 25*c* is provided between itself and the heat-resistive layer 25*a* of polyimide or the like, by which the releasing layer 25*b* and the heat-resistive layer 25*c* are heat-bonded.

The fluorine resin film is good in the surface smoothness, and therefore, the off-set preventing effect can be enhanced, and in addition, the strength of the releasing layer becomes strong. Therefore, it is particularly effective for the case of low fixing speed and the case of a large heat generation amount by the heat generating element.

EXAMPLE 1C

As described, by the provision of the bonding layer, the contact between the layers is improved. From the standpoint of the thermal response of the fixing film, the thermal capacity of the fixing film is desirably low. This is particularly so, when the heater is energized pulsewisely, as disclosed in Japanese Laid-Open Patent Application No. 313182/1988.

Figure 35:
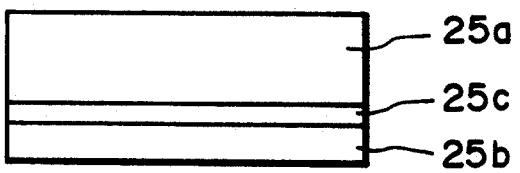
Figure 36:
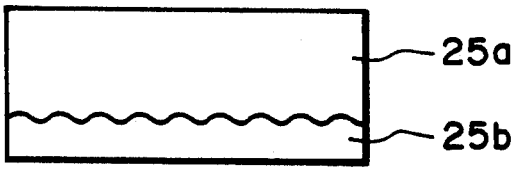

In FIG. 35 embodiment, the contact between the heat-resistive layer 25*a* and the releasing layer 25*b* is improved without provision of the bonding layer. In this embodiment, the surface of the heat-resistive layer 25*a* is roughened, and the releasing layer 25*b* is coated on the roughened surface. Because the bonding layer is not employed in this embodiment, the thermal capacity of the fixing film is not increased, and therefore, it is particularly effective when the heat generating element is pulsewisely energized.

EXAMPLE 1D

Figure 37:
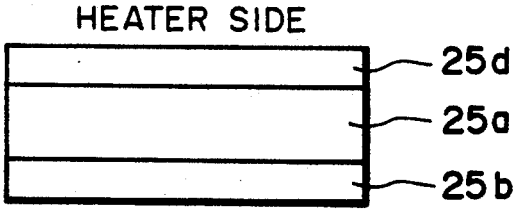

In FIG. 37, the heater side of the heat resistive layer 25*a* is provided with a sliding layer 25*d* having a good sliding property. In this structure, the frictional resistance between the fixing film and the heater is reduced, by which the driving force for the sheet is reduced, and the travel of the sheet can be stabilized. Therefore, this is particularly effective when the heater and the sheet are relatively slid.

EXAMPLE 1E

Figure 38:
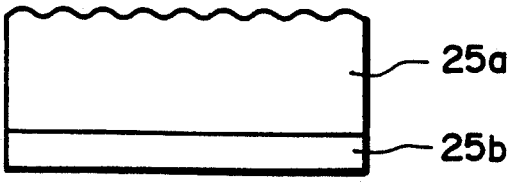

FIG. 38 shows an example by which the friction between the sheet and the heater is reduced without increasing the thermal capacity of the sheet. In this example, the surface of the sheet which is in sliding contact with the heater is roughened to reduce the actual contact area between the sheet and the heater.

EXAMPLE 1F

When the releasing layer 25*b* or the sliding layer 25*d* require a further high hardness, a high hardness material such as titanium oxide or titanium nitride may be added into the layer.

In the examples described above, the mechanical strength and the heat resistivity of the entire fixing film is provided by the heat-resistive layer 25*b*, and the releasing property relative to the toner is assured by the provision of the releasing layer 25*d*, and therefore, it is good in the durability and the off-set preventing effect.

When the heat resistive layer is made of a highly heat resistive resin such as polyimide, the fixing film is electrically charged with the result that the unfixed toner image is disturbed by the electrostatic force during the fixing operation, as the case may be. If this occurs, the above-described high off-set preventing effect is deteriorated. In addition, when the fixing film is electrically charged, and the surface potential thereof is increased, an electric discharge is produced between itself and another part of the apparatus with the result of noise production. If this occurs, there is a liability that the control circuit in the microcomputer or the like is erroneously operated.

The description will be further made as to an example, by which the electric charging of the fixing film can be prevented. The surface layer of other than the heat resistive layer 25*a*, particularly at least the releasing layer 25*b* is treated for low electric resistance.

EXAMPLE 1G

The releasing layer 25*b* in this example is a PTFE layer in which carbon particles or fibers such as carbon black, Ketchen black or graphite to make the volume resistivity of the PTFE layer $10^8$ ohm.cm.

Because the resistance is low, the electric charging of the fixing film is prevented, so that the unfixed toner image is prevented from being disturbed by the electrostatic force. In addition, the attraction of foreign matters by the sheet is prevented. If the foreign matters are attracted on the sheet, the releasing property is deteriorated, and the pressing roller 28 is damaged.

Where the fixing film 25 is not endless one, and is in the take-up type shown in FIG. 33, since the fixing film is overlapped the high resistance surface side of the fixing film is contacted to the low resistance side, by which the electric charge is dissipated. That is, if only one of the surface of the fixing layer is low in the electric resistance, the charge preventing effect on the surface of the fixing film contactable to the toner image can be more or less provided. However, it is preferable that the resistance of the surface layer of the toner is reduced.

Further, when the fixing film is in sliding contact with the heater, as shown in FIG. 32, a foreign matter is present between the heater 20 and the heater side surface of the fixing film due to the charging, with the result of the damage of the fixing film and the heater. In this embodiment, this problem can be solved.

Figure 39:
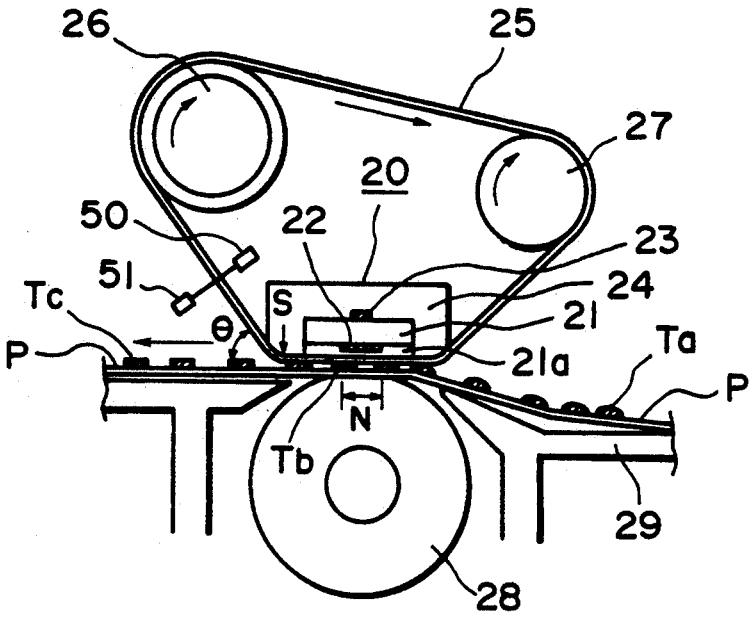
FIG. 39 is a sectional view of an image fixing film of another example.

In order to assure the charge preventing effect for the both sides of the fixing film, it is preferable that the electric resistance at each of the surfaces of the fixing film is reduced. Similarly to FIG. 39 embodiment, a layer is added to the heater side of the heat resistive layer of the sheet, and the added layer is treated for the low resistance.

Alternatively, the low resistance filler material such as carbon black is added in the heat resistive layer to reduce the charging. However, it reduces the heat resistivity and the mechanical strength of the heat resistive layer, and it is further preferable that the filler is not added in the heat resistive layer.

The low resistance layer has a volume resistivity of $10^{11}$ ohm.cm or lower to provide the charge preventing effect. Particularly, the charge preventing effect is further assured if it is $10^9$ ohm.cm or lower.

The low resistance filler material is not limited to the carbon material, but may be titanium nitride, potassium nitride, copper or iron oxide red.

The releasing layer 25b and the sliding layer 25d of the endless fixing film were made of PTFE having the volume resistivity of $10^{15}$ ohm.cm or higher without the low resistance filler material such as carbon black. Using this sheet, the fixing operation was continuously repeated for a long period of time. The fixing film was electrically charged, with the result that foreign matters were attracted on the fixing film, that the unfixed toner image on the recording medium was disturbed, and that the electric discharge occurred between itself and a grounded part, by which the control circuit including the microcomputer was erroneously operated.

The reasons for this are considered as follows:

(1), The fixing film 25 is electrically charged by peeling discharge at the time when the fixing film 25 is separated from the recording medium by the supporting member 24:

(2) The fixing film 25 is electrically charged by the rolling frictional charging and peeling charging at the time when it is driven by the driving roller 26 and the follower roller 27: and (3) The fixing film 25 is electrically charged by the frictional charging by the sliding contact with the heater 20.

EXAMPLE 1H

The used low resistance filler material was titanium oxide whisker material which is a single crystal fibers having electric conductivity (volume resistivity is $10^4$ ohm.cm). By the introduction of the conductive whisker fibers, the electric charging was prevented, and in addition, the wearing is reduced because the whisker material has high hardness. Thus, the durability of the fixing film is further improved.

EXAMPLE 1I

Figure 40:
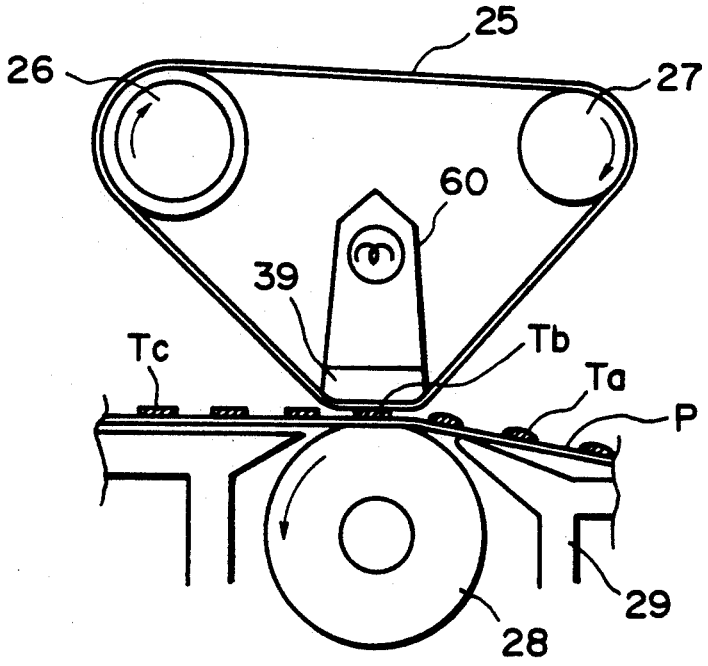

In the structure of Example 1a, a sheet discharging means 50 and 51 for electrically discharging the sheet (discharging brush made of carbon fiber or the like, for example) were contacted to the film. By doing so, the charge preventing effect of the fixing film is further improved, and in addition, the high charge preventing effect can be provided even if the amount of the low resistance filler material is reduced. The discharging means may be provided at only one side. The discharging effect is improved by making the driving roller 26 and the follower roller 27 with a conductive material such as metal. Referring to FIG. 40, a further embodiment of the present invention will be described. In place of the heater 20, a transparent member made of heat resistive glass or the like is disposed. Through the transparent member, the toner image is heated from a radiation source 60 such as halogen lamp disposed in the inside of the endless fixing film 25.

In this embodiment, the fixing film is made of a material which can transmit the wavelength of the radiation energy. In this embodiment, the fixing film includes a heat resistive layer 25a made of transparent polyimide containing fluorine and a releasing layer 25b made of transparent silicone resin.

In this embodiment, the toner is heated by the radiation, and therefore, the toner is further instantaneously increased in temperature, heated and fused. Therefore, the sheet P may only be heated only when it is in the nip N, and therefore, the power consumption can be saved, and the temperature rise in the apparatus can be reduced.

The endless fixing film is not limited to the seamless cylinder, but it may be in the form of a cylinder having a seam. In that case, the peripheral length of the cylinder is larger than the length of the usable sheet P. By doing so, the seam is not contacted to the sheet P if the sheet is conveyed at a predetermined timing.

As described in the foregoing, according to the present invention, the fixing film is good in the mechanical strength, the durability and the releasing property, and therefore, the good fixing operation is possible for a long period of time.

While the invention has been described with reference to the structures disclosed herein, it is not confined to the details set forth and this application is intended to cover such modifications or changes as may come within the purposes of the improvements or the scope of the following claims.

We claim:

1. An image fixing apparatus, comprising:

a heater which is stationary during a fixing operation, said heater including a thermally conductive base plate and a heat generating resistor on said base plate, said resistor generating heat upon electric power supply thereto;

a heat insulating member for supporting said base plate;

a film in sliding contact with said heater and movable with a recording material carrying a toner image, wherein the toner image is heated by heat from said heater through said film;

wherein said film and the recording material are separated when a temperature of the toner image is higher than a glass transition point of the toner, and wherein said film is separated form said recording material by being guided by said heat insulating member at a position downstream of said base plate with respect to a movement direction of said film.

2. An apparatus according to claim 1, wherein the maximum temperature is higher than a toner fusing point.

3. An apparatus according to claim 1, wherein when the recording material and said film are separated, the temperature of the toner is lower than the fusing point.

4. An apparatus according to claim 1, wherein when the recording material and said film are separated, the temperature of the toner is higher than a toner softening point.

5. An apparatus according to claim 1, further comprising pressing means for urging said film and the recording material to said heater, wherein there is no air layer between said heat generating resistance and the toner.

6. An apparatus according to claim 1, wherein said heat generating resistor extends in a direction perpendicular to a movement direction of the recording material.

7. An apparatus according to claim 1, further comprising a holder for fixedly supporting said heater, and said holder, and wherein a cavity is formed between the holder and said heater.

8. An apparatus according to claim 1, wherein said heater has a thermal capacity in its longitudinal direction of $2.2\times10^{-1}$ J/K.min$^3$.

9. An apparatus according to claim 1, wherein said heat generating resistance has a thermal capacity in its longitudinal direction of not more than $2.05\times10^{-3}$ J/K.mm.

10. An apparatus according to claim 9, wherein said heat generating resistor is made of silver-palladium.

11. An apparatus according to claim 1, wherein said film has a thermal capacity per 1 cm$^2$ lower than $1.5\times10^{-2}$ J/K.

12. An apparatus according to claim 11, wherein said film has a thickness smaller than 40 microns.

13. An image fixing apparatus, comprising:

a heater;

a film movable while in contact with a recording material carrying a toner image, wherein the toner image is heated by heat from said heater through said film, said film having a plurality of layers, wherein at least one of the layers is a heat-resistive base layer, and a layer contactable with the toner image is a releasing layer;

wherein said film and the recording material are separated when a temperature of the toner image is lower than a maximum temperature provided by the heater and is higher than a glass transition point of the toner.

14. An image fixing apparatus, comprising:

a heater;

a film movable while in contact with a recording material carrying a toner image, wherein the toner image is heated by heat from said heater through said film, said film including a plurality of layers, wherein at least one of the layers is a heat-resistive base layer, and at least a surface layer contactable to the toner image is a low resistance layer;

wherein said film and the recording material are separated when a temperature of the toner image is lower than a maximum temperature provided by the heater and is higher than a glass transition point of the toner.

15. An image fixing apparatus, comprising:

a heater;

a film movable while in contact with a recording material carrying a toner image, wherein the toner image is heated by heat from said heater through said film, said film is in the form of an endless belt;

wherein said film and the recording material are separated when a temperature of the toner image is lower than a maximum temperature of the toner image is lower than a maximum temperature provided by the heater and is higher than a glass transition point of the toner.

16. An image fixing apparatus, comprising:

a heater;

a film movable while in contact with a recording material carrying a toner image, wherein the toner image is heated by heat from said heater through said film;

wherein said film and the recording material are separated when a temperature of the toner image is lower than a maximum temperature provided by the heater and is higher than a glass transition point of the toner, the maximum temperature is within a range in which a high temperature toner offset occurs.

17. An image fixing apparatus, comprising:

a heater which is fixed during fixing operation of said fixing apparatus, and including a heat generating resistor generating heat upon electric energization;

a film movable in contact with the recording material, said recording material carrying a toner image, wherein the toner image is heated by heat from said heat generating resistor through said film;

wherein said film and the recording material are separated at a position downstream of said heat generating resistor with respect to as movement direction of said film;

and wherein a temperature of the toner image is decreased between said heat generating resistor and a position where said film and the recording material are separated, and a temperature of the toner is higher than a glass transition point of the toner at the separating position.

18. An apparatus according to claim 17, wherein the maximum temperature is higher than a toner fusing point.

19. An apparatus according to claim 17, wherein the temperature of the toner at the separating position is lower than a fusing point of the toner.

20. An apparatus according to claim 17, wherein when the recording material and said film rate separated, the temperature of the toner is higher than a toner softening point.

21. An apparatus according to claim 17, wherein said film and the recording material are contacted at a position upstream of and including said heat generating resistor with respect to a movement direction of said film.

22. An apparatus according to claim 17, further comprising pressing means for urging said film and the recording material to said heater, wherein there is no air layer between said heat generating resistance and the toner.

23. An apparatus according to claim 17, wherein said heat generating resistor extends in a direction perpendicular to a movement direction of the recording material.

24. An apparatus according to claim 17, wherein the toner is heated to the maximum temperature at a position where it is opposed to said heat generating resistor.

25. An apparatus according to claim 17, further comprising a holder for fixedly supporting said heater, and said holder, and wherein a cavity is formed between the holder and said heater.

26. An apparatus according to claim 17, wherein said heater has a thermal capacity in its longitudinal direction of $2.2\times10^{-1}$ K/K.mm$^3$.

27. An apparatus according to claim 17, wherein said heater has a good thermal conductivity, and an insulating layer is formed on said heater.

28. An apparatus according to claim 17, wherein said heat generating resistance has a thermal capacity in its longitudinal direction of not more than $2.05\times10^{-3}$ K/K.mm.

29. An apparatus according to claim 28, wherein said heat generating resistor is made of silver-palladium.

30. An apparatus according to claim 17, wherein said film has a thermal capacity per 1 $cm^2$ lower than $1.5\times10^{-2}$ J/K.

31. An apparatus according to claim 30, wherein said film has a thickness smaller than 40 microns.

32. An apparatus according to claim 17, wherein said film has a plurality of layers, and at least one of the layers is a heat-resistive base layer, and a layer contactable with the toner image is a releasing layer.

33. An apparatus according to claim 17, wherein said film includes a plurality of layers, and wherein at least one of the layers is a heat-resistive base layer, at least a surface layer contactable to the toner image is a low resistance layer.

34. An apparatus according to claim 17, wherein said film is in the form of an endless belt.

35. An apparatus according to claim 17, wherein the maximum temperature is within a range in which a high temperature toner offset occurs.

* * * * *

UNITED STATES PATENT AND TRADEMARK OFFICE

CERTIFICATE OF CORRECTION

PATENT NO. : 5,262,834
DATED : November 16, 1993
INVENTOR(S) : KENSAKU KUSAKA, ET AL.

It is certified that error appears in the above-indentified patent and that said Letters Patent is hereby corrected as shown below:

COLUMN 1
Line 33, "an" should read --a--;
Line 44, "are" should read --is--; and
Line 53, "deterioration" should read --deteriorating--.

COLUMN 5
Line 44, "heatgenerating" should read --heat generating--; and
Line 58, "is" should be deleted.

COLUMN 13
Line 17, "save of the" should read --saving of--.

COLUMN 16
Line 20, "is" should read --are--.

COLUMN 17
Line 15, "22, The" should read --22. The--.

COLUMN 21
Line 44, "is made" should be deleted; and
Line 67, "con-" should read --is con- --.

UNITED STATES PATENT AND TRADEMARK OFFICE

CERTIFICATE OF CORRECTION

PATENT NO. : 5,262,834

DATED : November 16, 1993

INVENTOR(S) : KENSAKU KUSAKA, ET AL.

It is certified that error appears in the above-indentified patent and that said Letters Patent is hereby corrected as shown below:

COLUMN 24

Line 45, "pencel" should read --pencil--;

Line 51, "or" should be deleted.

COLUMN 25

Line 18, "having" should read --has--.

COLUMN 29

Line 11, "J/K.min$^3$." should read --J/K.mm$^3$--.

COLUMN 30

Line 33, "rate" should read --are--;

Line 59, "K/K.mm$^3$." should read --J/K.mm$^3$--;

Line 66, "K/K.mm$^3$." should read --J/K.mm$^3$--.

Signed and Sealed this

Twenty-eighth Day of June, 1994

Bruce Lehman

*Attest:*

BRUCE LEHMAN

*Attesting Officer*

*Commissioner of Patents and Trademarks*